US007762492B2

(12) United States Patent
Muderlak et al.

(10) Patent No.: US 7,762,492 B2
(45) Date of Patent: Jul. 27, 2010

(54) HANDLE COVER DISPENSER

(75) Inventors: Todd J. Muderlak, Shorewood, WI (US); Kenneth J. Muderlak, Milwaukee, WI (US)

(73) Assignee: Muderlak Design, Inc., Milwaukee, WI (US)

( * ) Notice: Subject to any disclaimer, the term of this patent is extended or adjusted under 35 U.S.C. 154(b) by 615 days.

(21) Appl. No.: 11/279,678

(22) Filed: Apr. 13, 2006

(65) Prior Publication Data

US 2007/0241125 A1 Oct. 18, 2007

(51) Int. Cl.
*B65H 35/02* (2006.01)

(52) U.S. Cl. ..... 242/525; 242/530.1; 242/538.3; 242/541; 242/548; 16/412; 49/460

(58) Field of Classification Search ..... 242/525, 242/530, 534.2, 538, 538.1, 538.2, 1, 563.2, 242/566, 538.3; 16/412, 414; 70/30, 49, 70/233; 49/460
See application file for complete search history.

(56) References Cited

U.S. PATENT DOCUMENTS 2,903,734 A * 9/1959 Inman ..... 16/437
3,280,491 A * 10/1966 Klein ..... 353/26 R
4,046,508 A 9/1977 McDonald (Continued)

FOREIGN PATENT DOCUMENTS

DE 202004014950 U1 2/2005
EP 0448122 A2 3/1991

OTHER PUBLICATIONS

The Wall Street Journal online, http://online.wsj.com/article_print/SB120304303081570707.html, Feb. 15, 2008.
Foreign Office Action mailed Sep. 4, 2009; Application No. 07760455.1.

*Primary Examiner*—John Q. Nguyen
*Assistant Examiner*—Juan J Campos
(74) *Attorney, Agent, or Firm*—Whyte Hirschboeck Dudek S.C.

(57) ABSTRACT

Disclosed herein is a device for dispensing and collecting handle or armature cover material or covers for use, by way of example, with door handles, knobs, and the like. In one embodiment, the device is an automated handle cover dispenser that can include a dual use handle cover refill cartridge for both supplying and collecting handle cover material, or alternatively, a plurality of reels or cartridges (e.g., a supply reel and a take-up reel). The material, when supplied, at least partially covers a handle (e.g., door handle) during use by a consumer. This maintains sanitary integrity of the handle, so as to protect a consumer or other individual from touching an otherwise dirty or unsanitary handle. The dispenser can include at least one cutter for cutting at least one side of the handle cover material so as to facilitate supply, and in particular, collection of the handle cover material. Supply and take-up of the handle cover material can be accomplished by winding and unwinding of the handle cover material within the handle cover refill cartridge(s) (or reel(s) as the case may be). In one embodiment, the handle cover material overlays at least a portion of a handle (which can comprise one or more pieces or sections), door handle, knob, or the like. The dispenser unit can compliment or replace (and thus serve as a retrofit) current lockable or non-lockable door armatures.

30 Claims, 19 Drawing Sheets

U.S. PATENT DOCUMENTS 4,213,212 A 7/1980 Hefty et al.
4,566,648 A * 1/1986 Hefty et al. ..... 4/243.3
4,644,689 A 2/1987 Arians
4,658,469 A * 4/1987 Hawkins ..... 16/412
4,710,634 A 12/1987 Brookes
4,817,239 A 4/1989 Campbell et al.
4,997,139 A * 3/1991 Menard ..... 242/535
5,253,372 A * 10/1993 Boker ..... 4/243.2
5,561,867 A * 10/1996 Roginsky ..... 4/244.2
5,647,074 A 7/1997 White, Jr. et al.
5,937,448 A 8/1999 Brill et al.
5,975,083 A 11/1999 Henderson, Jr.
5,983,454 A 11/1999 Hartselle, III
6,076,198 A * 6/2000 Meierdierck ..... 4/243.2
6,189,183 B1 2/2001 Hartselle, III
6,213,424 B1 4/2001 Helfer-Grand
6,237,805 B1 5/2001 Katsanevas
6,289,557 B1 9/2001 Manson et al.
6,293,598 B1 9/2001 Rusiana
6,308,346 B1 * 10/2001 Brill et al. ..... 4/243.2
6,353,971 B1 3/2002 Krawczyk
6,508,383 B2 1/2003 Lidahl et al.
6,546,765 B1 * 4/2003 Linares ..... 70/210
6,645,435 B2 11/2003 Dawson et al.
6,749,148 B2 6/2004 Helfer-Grand
6,789,695 B1 9/2004 Gaudreau
7,201,415 B2 * 4/2007 Elwell ..... 296/1.08

* cited by examiner 2
34
32b
6
11
10
32a
36
32c
40
24
16
26
28
22
38c
20
30

20
76
58
54
70a
70
62
60
72

67
69
30
74
52
56
28
18
14
100
12

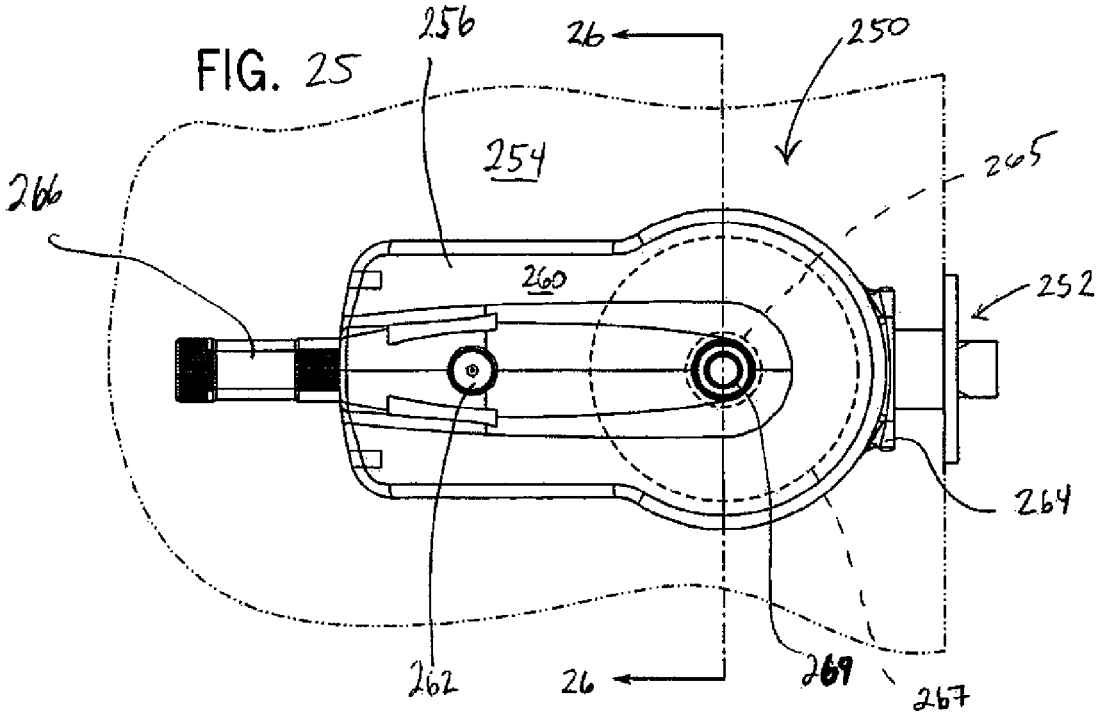
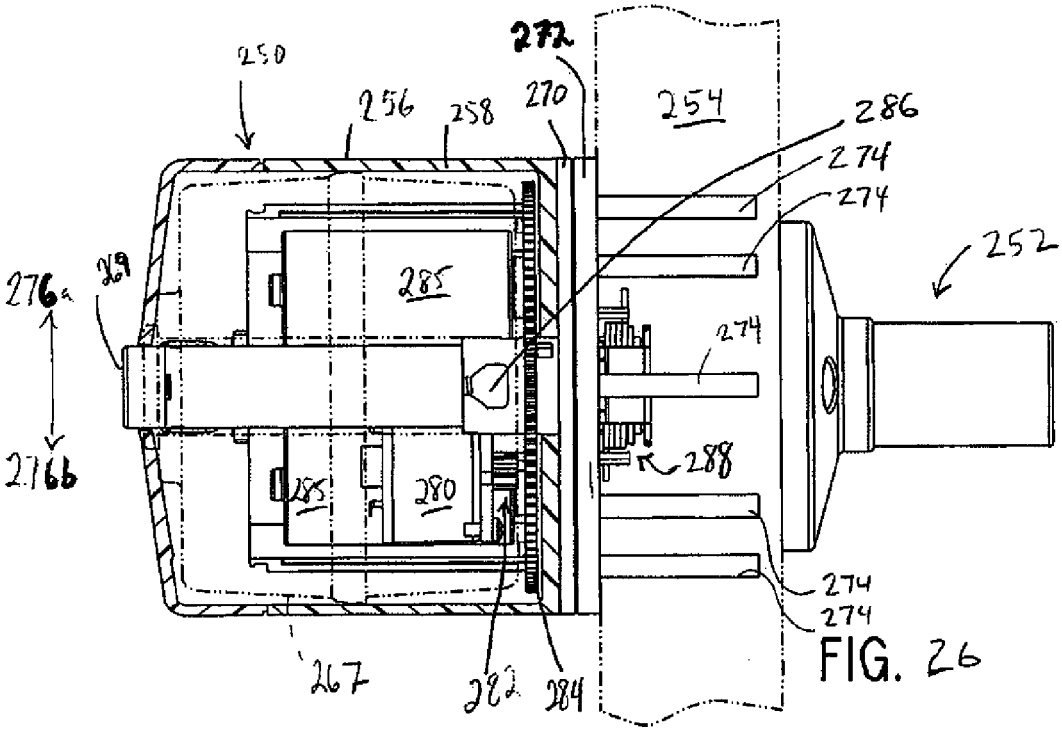
FIG. 26

FIG. 29
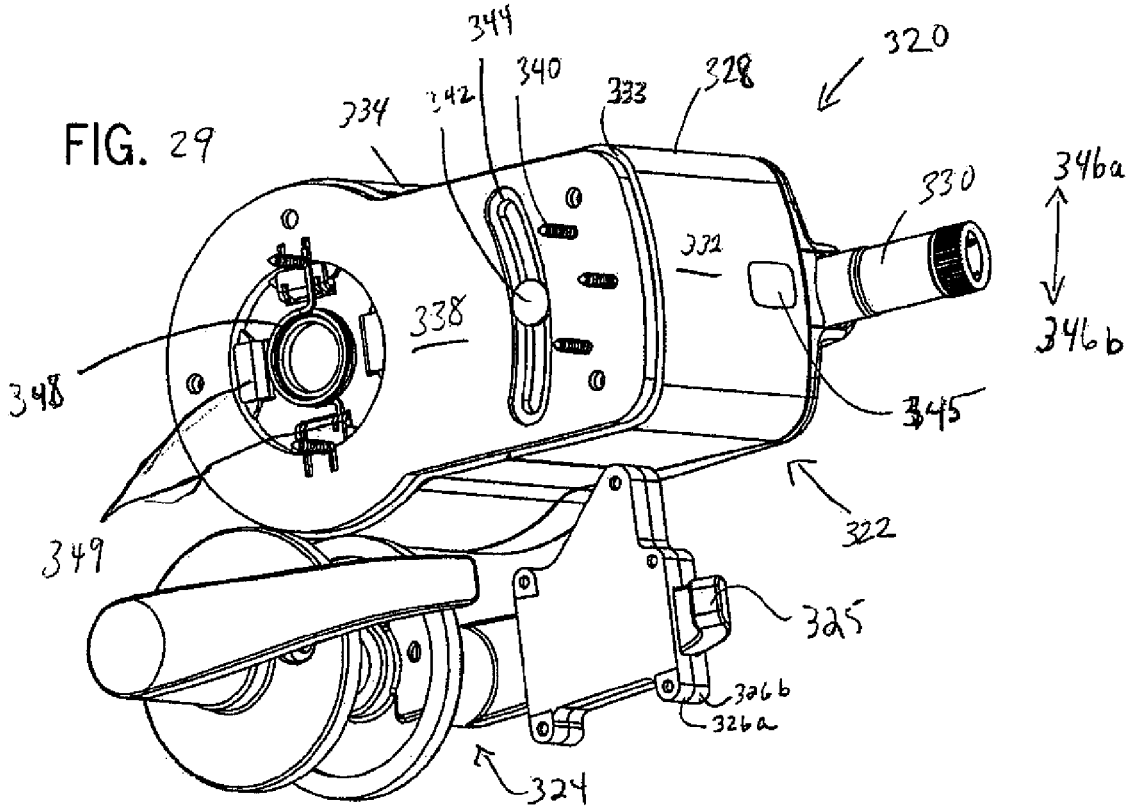
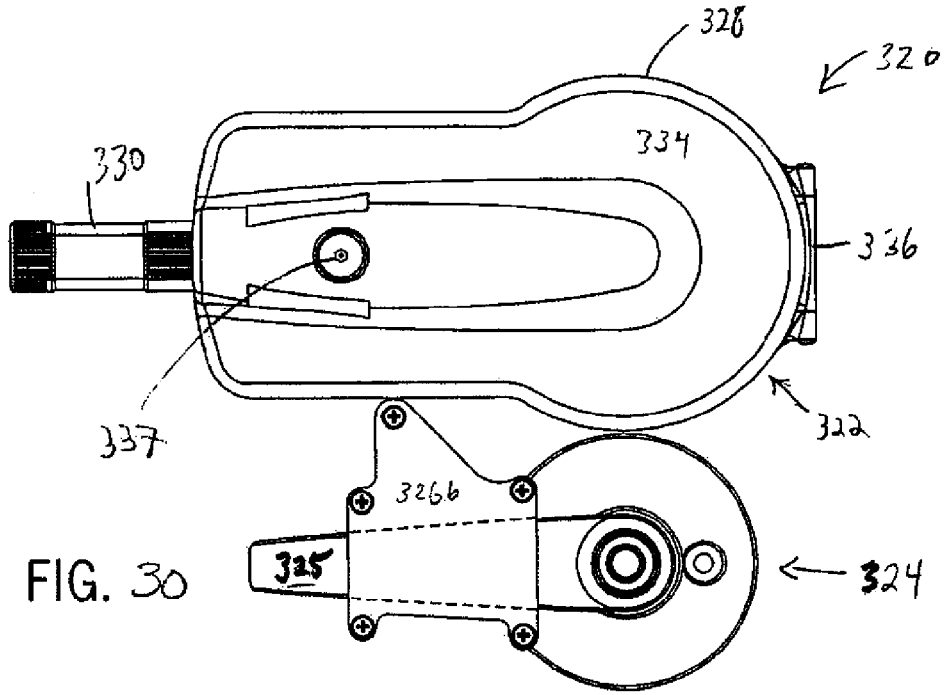
FIG. 30

HANDLE COVER DISPENSER

FIELD OF THE INVENTION

The present invention generally relates to the covering handles, and more particularly, to devices, assemblies and methods for dispensing sanitary handle cover(s) and/or handle cover material in an automated fashion.

BACKGROUND OF THE INVENTION

Virtually every day, people encounter surfaces that have been frequently touched. For example, they pass through doorways having handles when entering and leaving buildings (e.g., homes, office buildings, etc.) and rooms (e.g., bathrooms, cafeterias). Many devices (e.g., grocery carts, hand trucks, etc.) also have handles to facilitate their use. Such surfaces can be contaminated with bodily fluids, such as sweat and mucus. Moreover, illness (both mild and severe), such as the common cold, can be passed through hand touch. As a result, many people adjust their behavior due to actual and/or perceived unsanitary conditions associated with such frequently touched surfaces. However, in some instances, avoidance and/or behavior change is not feasible.

For example, in the restroom setting, persons with dry or clean hands (whether they have washed them or not) exiting from a restroom or the like find it bothersome to grab the door handle for opening the door only to find an unsanitary, or at least seemingly unsanitary (e.g., a wet handle) by reason of the last person exiting the room failing to either wash his hands or dry washed hands. Accordingly, both people who have washed their hands, as well as those who have not, often try to avoid touching any surface (e.g., a door handle). However, the person typically must touch the handle of the door to exit the restroom, and thus touching a surface of the restroom such as a door handle is nearly unavoidable. Large restrooms in some instances have separate entrance and exit doors that can be pushed open in the direction of travel (i.e., pushed or pulled away from the user in either specific direction of travel). With these types of doors a person can select a dry portion to push against for exit. Still, even in these instances, the dry portion may not be sanitary.

Many small restrooms, such as those commonly found in service stations, coffee shops, office buildings and the like, have a common entrance and exit door which is pushed inward for entrance and pulled inward via a handle for exit. Other restrooms have doors that open in an opposite fashion, that is, a user must push on a door portion and/or handle to exit. Moreover, there are restrooms that oftentimes have handles that require an individual to grasp and turn the handle to open or close the door, as well as to lock and unlock (e.g., via a latch and a spring-loaded push lock) the handle and door. Turning or moving the handle in such instances typically automatically unlocks the door. Door handle internal components to lock and/or unlock lockable doors are well known in the art (and thus they will not be described in detail herein).

In general, it can be stated that many persons exiting restrooms do not wash, or thoroughly wash, their hands. Still where there are handles, all or virtually all persons exiting the restroom touch the handle. Some people carry gloves, wipes or the like to use in such public restrooms. Some people take extra paper towel(s) to use to cover the door handle. Others carry sprays and liquids to apply to the door handle prior to usage or apply to their hands after use. These techniques are aimed at improving the sanitary or perceived sanitary condition of the handle. However, they are inefficient since they effectively "treat the symptom(s)" and do not solve the problem(s) and can be wasteful, expensive and create additional untidiness. Perhaps more significantly, such techniques are ad hoc, and as such, not everyone using the door benefits from such solutions.

Covering a handle (e.g., door handle) during use is an effective way to prevent a person from touching the handle. However, previous devices (e.g., UV mechanisms, foot levers, arm levers, etc.) and means to avoid handle contact and/or result in a sanitary handle touch have been characterized by numerous problems including: a) costly and/or complicated installations, dispensers, and refills; b) mechanical problems during door handle cover dispensing, such as jamming and breaking; c) high maintenance; d) fixed (as opposed to variable) and relatively low number or low capacity of sanitary experiences prior to re-fills being required; e.) may not be compliant with certain regulatory requirements; f) difficult to use; g) it is not apparent that solution offers a sanitary experience. Automating doors to eliminate touching is another option that is typically expensive to accomplish and maintain. Moreover, such doors require significant and sometimes unique spacing requirements and have tended to be characterized by slow operation.

In general, previous solutions have been cumbersome, costly, impractical, and/or inefficient. Thus, it would be desirable to provide a mechanism to maintain a sanitary and dry handle surface, for example, on the doors used for exiting rooms, including restrooms without the encountering the weaknesses of the aforementioned alternatives. It would further be desirable to provide an automated way to sanitize and otherwise maintain the cleanliness of handles for a user that solves the aforementioned problems in a practical, easy-to-install (e.g., the device can be affixed to a structure, such as a door, in any orientation), efficient and cost effective manner. Further, it would be desirable to provide a device and method to accomplish and/or maintain a sanitary handle in an automated fashion that is suitable for use with lockable doors, such as those described above.

BRIEF SUMMARY OF THE INVENTION

In one embodiment of the invention, a handle cover dispenser is disclosed herein. The dispenser includes a housing, a motor disposed within an interior of the housing, a handle extending from the housing, and a dual-use handle cover refill cartridge disposed within the housing interior. The dual-use handle cover refill cartridge is in operational association with the motor. The dual-use handle cover refill cartridge is capable of both supplying to and collecting from the handle a handle cover material such that the handle cover material, when supplied, at least partially covers the handle.

These and other important features, hallmarks and objects of the present invention will be apparent from the following descriptions of an embodiment of the invention which follow.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals are used to indicate like components.

In the drawings:

FIG. 25 is a front view of the integrated automatic handle cover dispenser and lockable door handle assembly shown in FIG. 23;

FIG. 26 is a partially schematic cross-sectional view of the integrated automatic handle cover dispenser and lockable door handle assembly taken along line 26-26 of FIG. 25;

FIG. 29 is a rear perspective view of a retrofit automatic handle cover dispenser and lockable door handle assembly in accordance with one aspect of the present invention;

FIG. 30 is a front view of the retrofit of FIG. 29;

DETAILED DESCRIPTION OF THE PREFERRED EMBODIMENT

Figure 1:
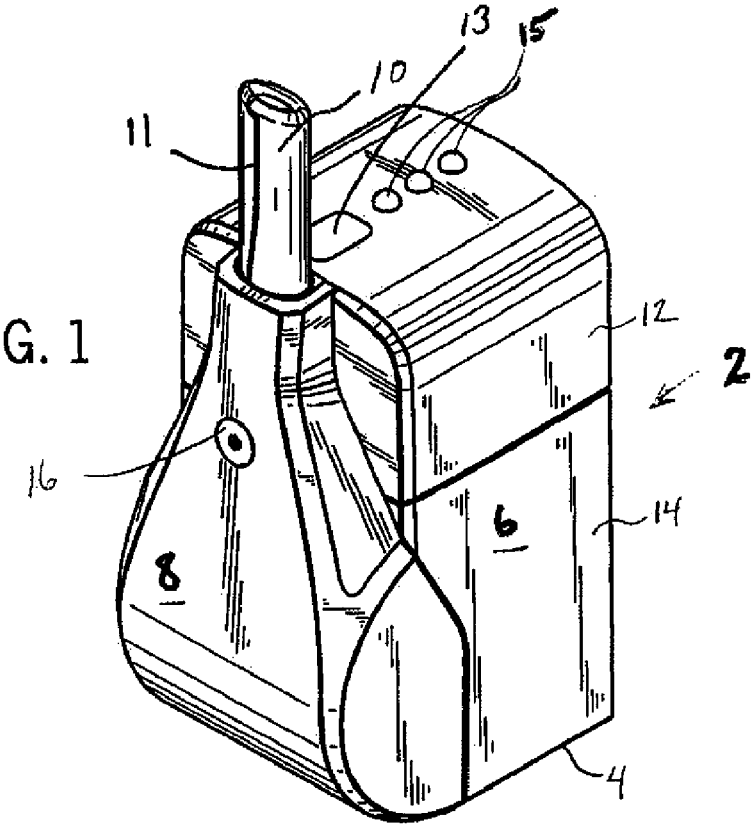
FIG. 1 is a perspective view of an automatic handle cover dispenser in accordance with at least one embodiment of the present invention.
Figure 2:
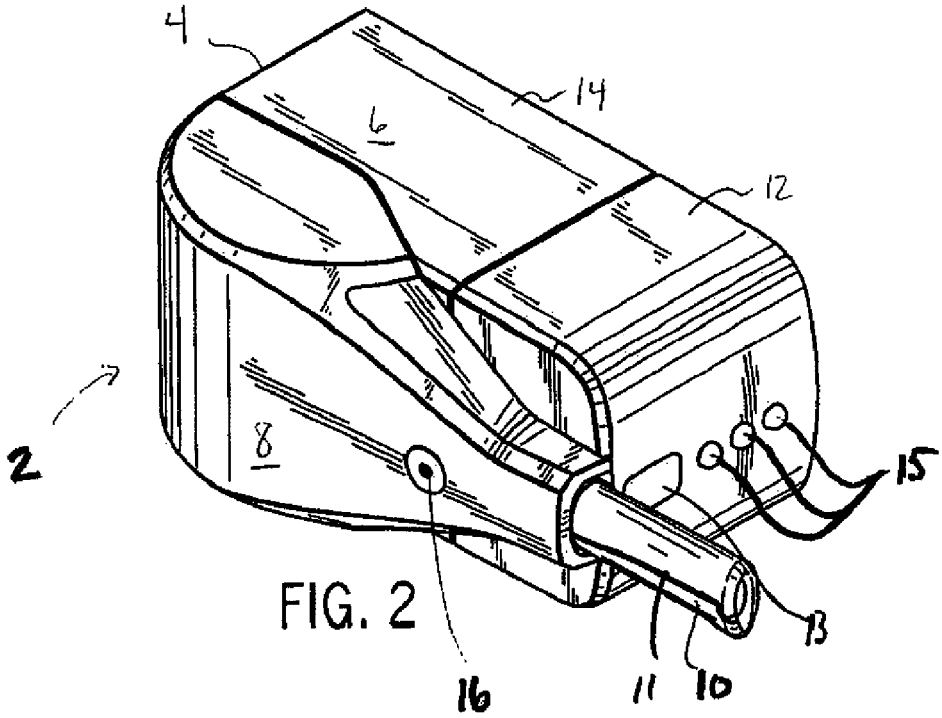
FIG. 2 is a perspective view of the automatic handle cover dispenser in a different orientation such that the handle shown is facing sideways.

FIGS. 1 and 2 are perspective views of handle cover dispenser 2 in accordance with at least one embodiment of the present invention. The dispenser 2 includes a housing, generally referred to by the numeral 4. The housing 4 covers the internal electro-mechanical components of the dispenser 2, including the components used for dispensing a plurality of handle covers, and the housing houses the handle covers as well (although they are not shown in the present view). As used herein, the term "handle" includes parts that are designed to be held, touched, or operated by one's hand(s). The term handle is generally used since at least some embodiments of the invention have applicability to uses other than with doors (e.g., grocery carts, etc.). Still, with respect to doors, the term handle includes any device that can be used to open or close a door, including door handles, door armatures, door knobs, and the like. Moreover, the term a "handle" as used herein (including the claims) can include—but not necessarily require—the presence of various handle or handle-like components, including a handle portion, a handle overlay, a handle core, and the like.

Still referring to FIGS. 1 and 2, the housing 4 includes a main housing section 6 and a secondary housing section 8, which opens with respect to the main housing section, typically via a hinge (not shown in this view). Protruding from the secondary housing section is a handle 10. The handle 10 further includes a slot 11 to permit passage of handle covers, as will be described in greater detail below. The main housing section 6 further includes a first section 12 and a second section 14 disposed adjacent the first section. In general, the housing has a shape that is contoured to efficiently cover and contain the internal automatic handle cover dispenser device components (not shown in FIGS. 1 and 2) in an aesthetically pleasing fashion. For example, as shown, the first main housing section 12 is curved. It should be apparent to those of skill in the art that the shape of the housing 4 can vary to convenience without departing from the spirit and scope of the present invention, and that the invention should not be limited by any specific housing (or housing section, portion, etc.) shape. Also shown are holes 15 that are included to permit the viewing of light that is provided by a plurality of light sources (e.g., light-emitting diodes or "LEDs") contained within the housing (and not shown in this view). A lock 16 is included to fasten the secondary housing section 8 with respect to the main housing section 6 in secure fashion when the dispenser 2 is ready for use. IR location or window 13 is also included. Short or long wave object detection IR (long pulse/short pulse and high/low frequency) and/or capacitance sensing can be used to automatically advance handle cover material. LED's and the IR can be located underneath the window and behind the handle. The window can be sized and angled accordingly to ensure efficacy.

The automatic handle cover dispenser 2 is typically connected (directly or indirectly) to a door or other appropriate structure, for example a door (although not shown), and it should be understood that these and other embodiments of the present inventive dispenser can be oriented in any of a number of different ways. For example, referring to FIG. 1, the dispenser is oriented so that the handle 10 extends from the dispenser housing 4 in one direction (e.g., vertically), and referring to FIG. 2, the dispenser 2 is oriented so that the handle 10 extends from the dispenser in a direction which is approximately 90 degrees with respect to the direction shown in FIG. 1. Moreover, in these and other embodiments of the present invention, the dispenser can be oriented for left-hand, or right-handed use, as desired. As such, the relative orientation of the dispenser in its ultimate configuration (e.g., when attached to a door) can be selected based on a number of parameters, including by way of example, the end-use application, the intended user, etc. Still, it should be understood that the orientation of the device in its ultimate configuration can vary to convenience, and that the orientations illustrated herein with respect to the various embodiments are selected for purposes of illustration and explanation. As such, the invention should not be limited by any particular end-use orientation.

The handle cover material of the present invention typically take the form of a continuous material of sleeves or bags, one continuous sleeve or bag, or a plurality of connected and yet discrete handle covers that are typically made from a plastic or plastic-like material. The term "handle cover material" shall be used herein generally to describe types of handle covers suitable for use with respect to handles; however, the term should not be used in a limiting sense. For example, discrete handle covers are contemplated, as are discrete but still connected handle covers. The handle cover material of the kind contemplated for use in the present invention typically surround or substantially surround, in overlay fashion, the dispenser handle (or handle overlay), which in turn can function as the end use handle (e.g., a door handle) when the dispenser is positioned for use. The handle cover material is typically sized and shaped to conform to or mimic the size and shape of the handles. Still, various types, sizes and overall geometries for the handle cover material are contemplated and considered within the scope of the present invention beyond those described herein. Thus, the invention should not be considered limited to any particular handle cover material. It is contemplated that in embodiments of the present invention, polyethelene plastic material ranging from low to high density can be used, and such material is indicated here by way of example, but not limitation. Furthermore, handle cover material, in at least some embodiments, can be treated (or not treated) with static electricity treatment and printing of various logos, colors, etc.

Figure 3:
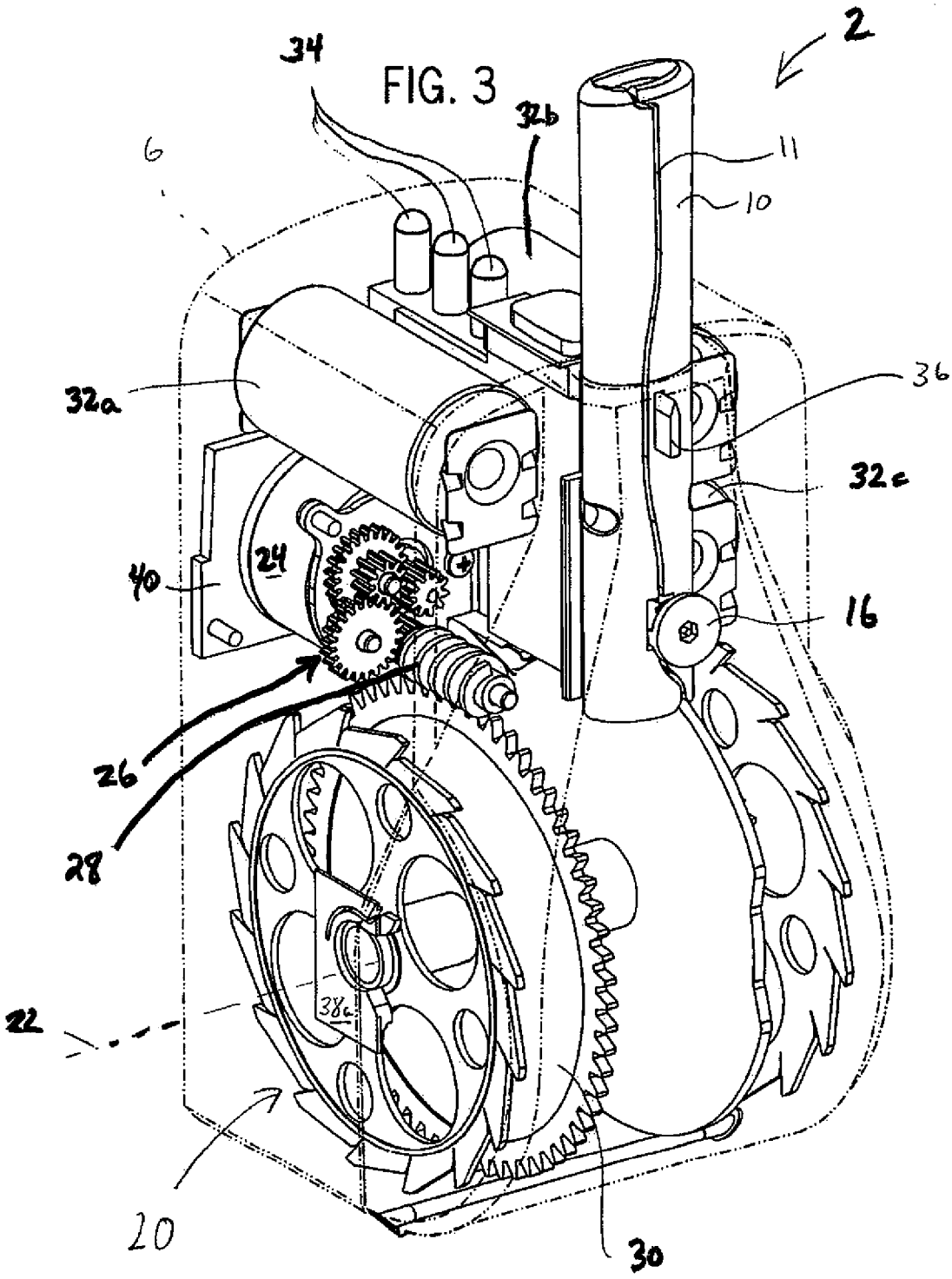
FIG. 3 is a front perspective view of the dispenser with the housing removed so as to show various internal components of the dispenser.
Figure 4:
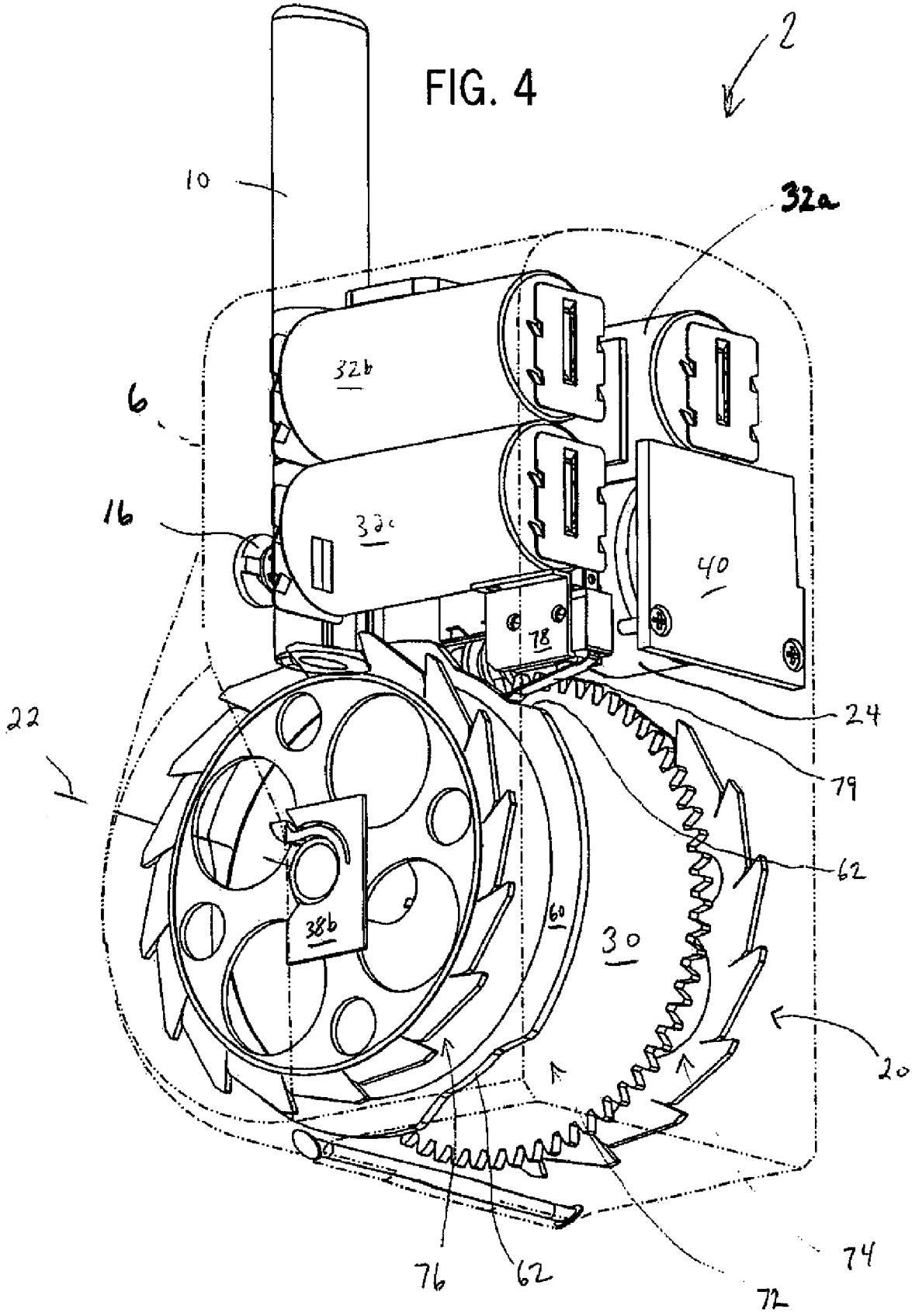
FIG. 4 is a rear perspective view of the dispenser shown in FIG. 3, again showing various of its internal components.

FIGS. 3 and 4 illustrate front and rear perspective views, respectively, of the dispenser 2 with the housing 4 removed (and shown in phantom) so as to observe various internal components of the dispenser. Handle 10 again is shown to include a slot 11 (FIG. 3). The handle 10 is positioned in operable association with respect to a handle cover refill cartridge, which is generally referred to by the numeral 20. As shown, the cartridge is a "dual-use handle cover refill cartridge" in that it is capable of both supplying and taking-up of the handle cover material as opposed to, for example, having two separate cartridges for supply and/or take-up (see FIGS. 35-36). This aspect of the cartridge will be illustrated and described further with respect to FIG. 6. When in use, the dispenser 2 is generally attached or otherwise secured to a structure, which would generally include a flat or substantially flat surface (and the dispenser would be attached to that surface).

As shown, the dual-use door handle cover cartridge 20 rotates in one direction (e.g., clockwise) about an axis 22 to dispense sanitary handle covers (not shown) and in a second rotational direction (e.g., counterclockwise) take up, collect or re-wind such covers once they are used (and typically soiled). It is notable that the axis 22 about which the cartridge 20 rotates extends in a direction that is generally parallel with respect to the structure, and more particularly the substantially flat surface of the structure, to which the dispenser would be attached. The dispenser 2 further includes a motor 24 connected to a gear train, generally referred to by numeral 26 (FIG. 3). In general, in these and other embodiments referred to herein, the motor drives rotation of the cartridge collection sections in a rotational direction (clockwise or counterclockwise) that depends, at least in part, on the manner in which the handle cover material is rolled onto or into the dual-use door handle cover cartridge. The handle cover material is pulled from the supply section and fed to the collection sections. Still referring to FIGS. 3 and 4, one exemplary motor suitable for use in the present invention is a DC motor, such as those provided by Mabuchi Motor or Johnson Motor, located in Japan, China and the USA, respectively. As shown, the motor 24, via the gear train 26, drives a worm gear 28 (FIG. 3). The worm gear 28 in turn is used to translate the motion from the gear train to drive rotation of the dual-use handle cover refill cartridge 20 via a drive gear 30. Other gears and gear trains are contemplated and considered within the scope of the present invention. A plurality of batteries 32 *a-c* (e.g., C, D, NiCad, AA, etc.), are shown, and these batteries can be used to power motor 24. The batteries can also be used to power the plurality of indicator LED's 34. The LED's 34 can be used to indicate, for example, depletion or near depletion of the sanitary handle cover material (here again not shown in this view), power, low battery and if the handle cover has been used or is a new sanitary handle cover. Various securing means can be used to fixedly secure the aforementioned components within and to the housing 6. For example, clips 38 *a* (FIG. 3) and 38 *b* (FIG. 4) are used to secure the dual-use handle cover refill cartridge 20 to the housing 6 (again shown in phantom). Clips 38 *a-b* serve to facilitate insertion and removal of the cartridge 20 from the housing 6, as well as to provide sturdy support for the cartridge once installed. Additionally, support 40 is used to secure the motor 24 into position within the housing 6.

Referring to FIG. 3, a cutter 36 (e.g., a blade) is used in the present embodiment to slice the handle cover material (again not shown). The cutter 36 is included and connected to the handle to facilitate collection of the handle covers on the dual-use cartridge following use. In the present embodiment, the blade cuts at two points on the handle cover. That is, the blade projects forward of the handle (as shown) and rearward from the handle (not shown). Since the handle 10 can be used to open a door (not shown), the handle is typically made of a strong and rugged material (e.g., cast metal, filled plastic, etc.). Lock 16 is again shown, and the lock is used to ensure secure access to the interior of the housing, limiting access for desired purposes (e.g., to permit removal of the dual-use cartridge).

Figure 5:
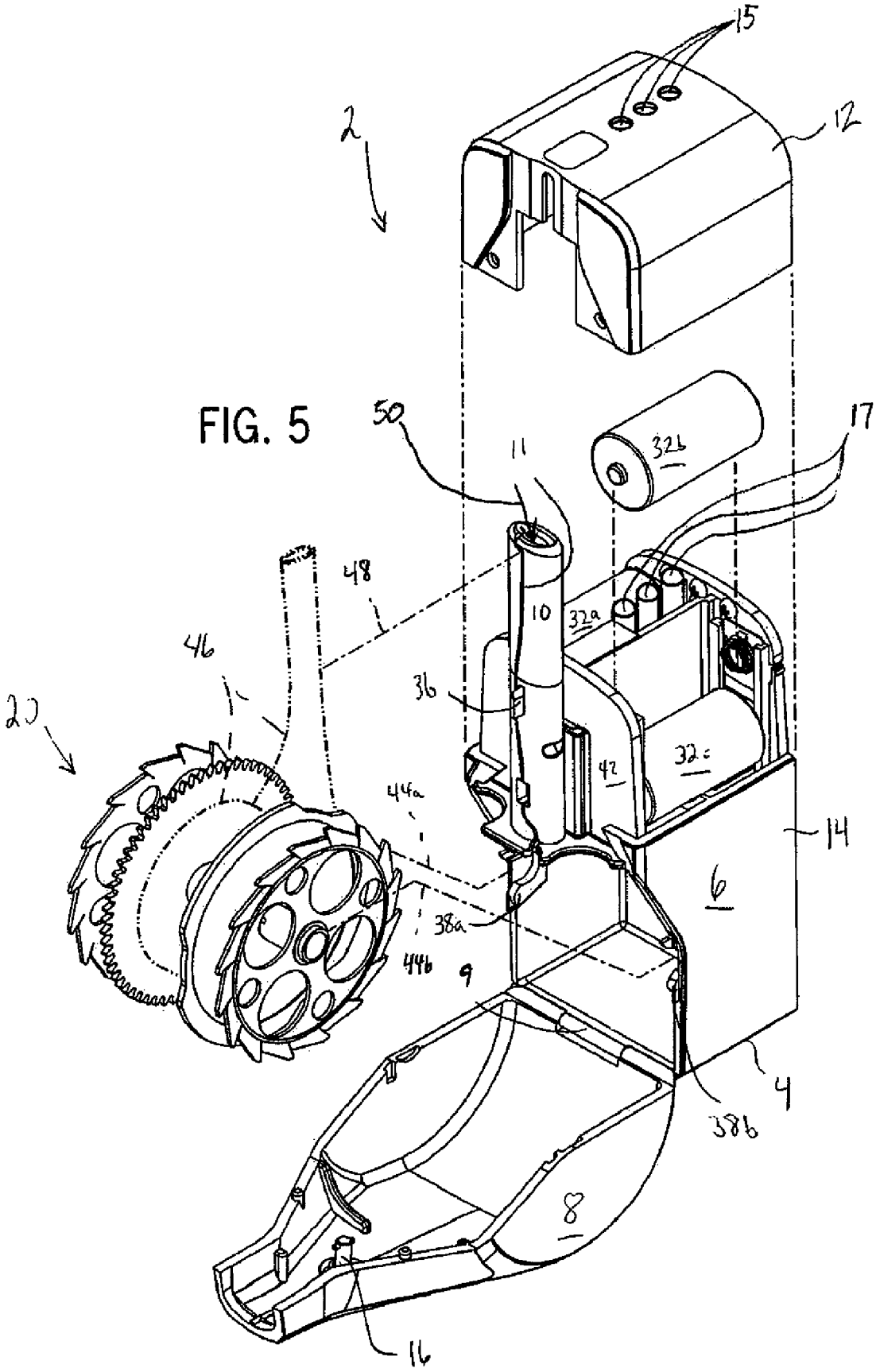
FIG. 5 is a front, partially exploded view of the dispenser, again showing various internal components, including a dual-use handle cover refill cartridge.

Turning to FIG. 5, a front, partially exploded view of the dispenser 2 is shown, including various components contained within the housing 4. Dual-use cartridge 20 is again shown. As noted above, the housing 4 includes a main housing section 6 and a secondary housing section 8. Handle 10 having slot 11 extends from a central housing support section 42 that is designed to contain various of the internal components, including components previously illustrated and described (e.g., a motor, batteries, etc.). Cutter 36 extends from the handle 10. As shown, the secondary housing section 8 has been pivoted about hinge 9 and is in an open position. The main housing section 6 includes a first cover section 12 which mates with a second section 14 and overlays central support section 42. These sections are shown in exploded relation to each other. The central support structure 42 is designed to support and contain several of the internal components of the dispenser 2. For example, batteries 32*a-c* are again shown, and these batteries are used to power handle cover dispensing, and are secured in a known manner. The number and type of batteries can vary depending on the power needs of the device and, as such, the orientation and number of batteries. Holes 15 are included to permit the viewing of indicator lights 17 (e.g., light-emitting diodes or "LEDs") contained within the housing and secured to the support structure 42, although the precise location can vary.

The dual-use handle cover cartridge 20 is designed to be inserted and secured within the interior of the housing 4 via clips 38*a-b*, with such installation indicated by dashed lines 44*a-b*. Handle cover material 46 are illustrated via dashed lines surrounding and contained within, as well as extending from, a central region of the cartridge. The handle cover material as shown comprises a continuous sleeve that is designed to overlay the handle 10. More specifically, the handle cover material 46 is positioned, as indicated by dashed line 48, within and so as to pass through a central region of handle 10, as indicated by arrow 50. A lock 16 is included to secure the secondary housing section 8 with respect to the main housing section 6. The lock can be key-specific, as opposed to a lock that can be opened using generally available implements (e.g., a screwdriver, etc.), and this feature can be customer-specific (i.e., vary from customer to customer). Also, if tampering or theft is not deemed an issue, the lock can be replaced with fastening means, e.g., a friction tab, which is not lockable.

Figure 6:
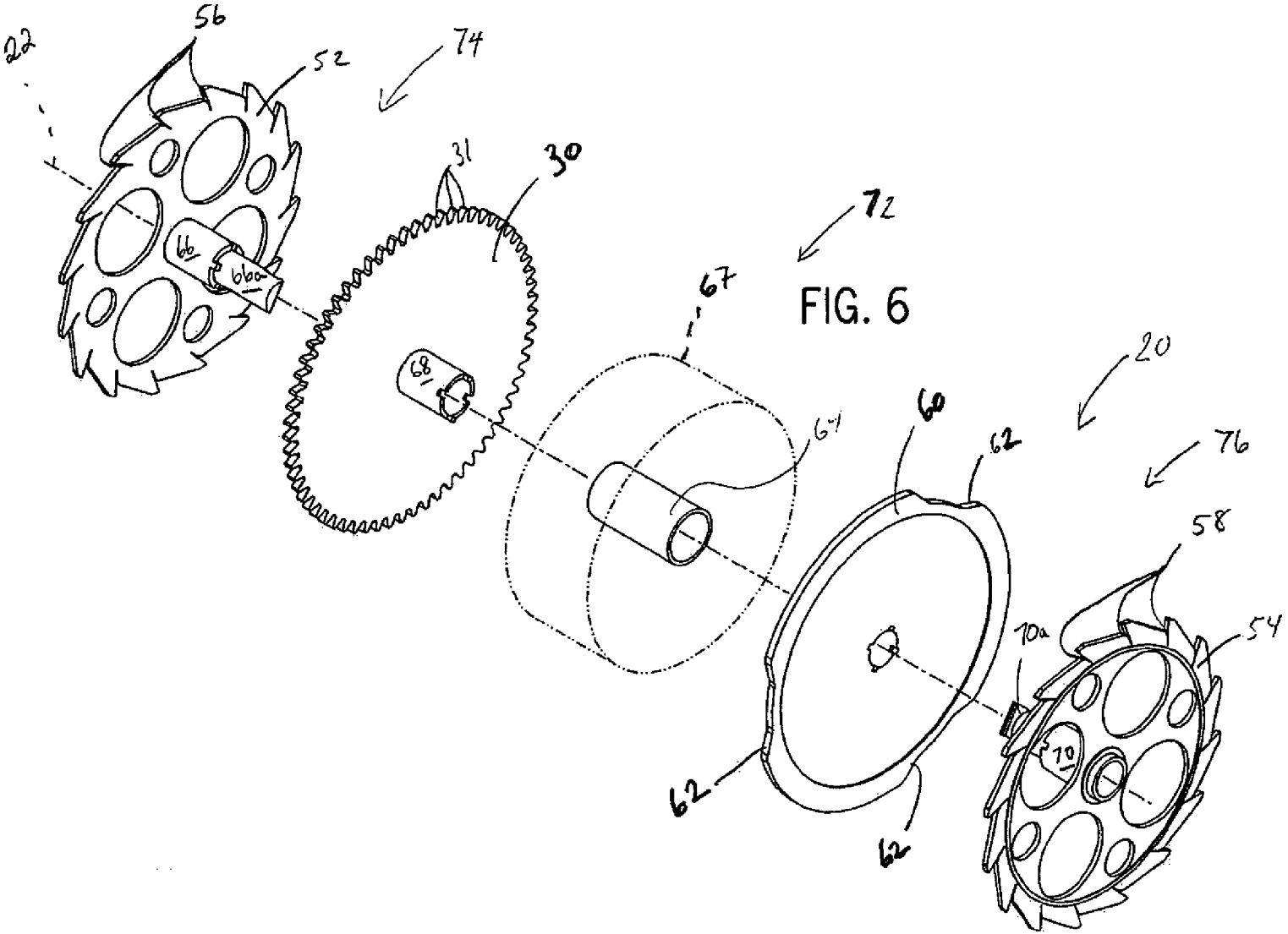
FIG. 6 an exploded view of various components of the dual-use handle cover refill cartridge.

FIG. 6 is an exploded view of the dual-use handle cover refill cartridge 20 according to one aspect of the present invention, with the cartridge shown exploded along rotation axis 22, about which the cartridge can rotate when in use (i.e., when dispensing and/or taking up handle covers). It should be understood that the cartridge can be contained within a cartridge housing, but such housing is removed here for purposes of explanation and clarity. The dual-use handle cover refill cartridge includes a pair of end caps 52, 54, with each of the end caps including a plurality of identical or substantially identical start slots 56, 58 respectively. The start slots 56, 58 are used to facilitate collection and/or re-winding of the handle covers following use (see FIG. 7). The dual-use handle cover refill cartridge 20 further includes a drive gear 30 that, as depicted and described previously, is driven by worm gear 28 (FIG. 3) via teeth 31 to cause rotation of the cartridge (once assembled) about the axis 22. The dual-use door handle cover cartridge 20 further includes a metering plate 60 having a plurality of notches 62 which are used, as noted above, to meter the amount or quantity of handle cover material to automatically dispense (or take up) during use. The metering plate is used in tandem with a switch that is described below. A spool 64 is used to contain and supply a continuous material of handle cover material 67 (shown in phantom). The size and configuration of the handle cover material 67 is variable. For example, the handle cover material 67 can be spooled flat or folded in half to reduce size of cartridge 20 and the dispenser 14.

Still referring to FIG. 6, the dual-use handle cover refill cartridge 20, end cap 52 includes a spool portion 66 having an extension 66*a* that connects or interfaces with drive gear extension portion 68. Drive gear extension portion 68 interfaces with spool 64, which in turn interfaces with extension 70*a* of spool portion 70 of end cap 54. Extension 70*a* passes through metering plate 60 along axis 22 to accomplish such interface. Assembly is accomplished in a known (e.g., snap-fit) manner. In this way, spool 64 is bounded by drive gear 30 and metering plate 60 to create a cartridge supply portion, generally referred to by numeral 72, from which handle covers 67 are supplied. Additionally, end cap spool portion 66 is bounded on either side by end cap 52 and drive gear 30 to create a first cartridge take-up or collection portion 74. Similarly, end cap spool portion 70 is bounded on either side by end cap 54 and metering plate 60 to create second cartridge take-up or collection portion 76. First and second cartridge take-up portions 74 and 76 accomplish take-up of used or soiled handle cover material. The dual-use handle cover refill cartridge 20 is termed "dual-use" or "multi-functional" since it includes both a supply portion 72 and at least one (but in the present embodiment as shown it includes two) take-up portions 74 and 76, can be termed "dual-use". In one embodiment, central spool 64 can have an outer diameter of about 2" and drive gear 30 can have an outer diameter (from one outer tooth to an opposing outer tooth) of about 12". However, it should be understood that the dual-use door handle cover cartridge can be sized to convenience.

Turning briefly to FIG. 4, the dual-use handle cover refill cartridge 20 is shown in assembled form to comprise the supply portion, again generally referred to by the numeral 72, and the pair of collection portions, generally referred to by the numerals 74 and 76, respectively. As shown, the dispenser 2 further includes a switch 78 that interfaces mechanically with the metering plate 60 of the dual-use handle cover refill cartridge 20 to meter and count door handle covers (not shown) during operation of the dispenser (i.e., dispensing and/or collection of door handle covers). More specifically the switch 78 comprises a tab 79 that contacts the metering notches 62 (generally one at a time) of the metering plate 60. In this way, the switch works in tandem with the cartridge to meter the appropriate amount or number of handle cover(s) to dispense following use of the device by a user. The switch also functions to enable the switch to monitor the amount or length of handle cover material dispensed in total. An appropriate signal can be provided (e.g., illumination of the previously described LED's or using a different color handle cover on the last specified number of handle cover feet) when the cartridge is empty or nearly empty (i.e., when the supply portion 72 of the cartridge is depleted or nearly depleted of handle covers). Depletion or emptying of the cartridge can also be detected using, for example, optical switches, capacitance, and the like. Again, the notches 62 of the metering plate are used to monitor movement of the door handle cover cartridge 20, and in particular, the notches contact the switch to accomplish this functionality. It should be understood that switches other than the electromechanical switch 78 shown and described here (e.g., infrared, capacitance, optical, magnetic, etc.) can be used accomplish monitoring and/or metering functionality and are contemplated to be within the scope of the present invention.

Referring again to FIG. 5, the dispenser 2 includes various electronics that are housed within the housing 4, and more precisely, positioned within central housing support section 42. As noted previously, LED's 17 are included to signal, for example, power on/off, low battery power status, if handle cover is used or new, that the dual-use handle cover refill cartridge 20 is in need of refill or replenishment (i.e., all or nearly all of the handle cover material has been dispensed), and the like. Additionally, in these and other embodiments of the invention described herein with respect to the FIGS., the dispenser further includes a printed circuit board ("PCB") that incorporates various LED's, switches, buttons, and other sensing device electronics. Such electronics and circuitry are known to those of skill in the art, and as such, can be varied without departing from the scope of the present invention.

With respect to the embodiments described herein, including the above-identified embodiment, the take-up or collection section (or collection sections) of the dual-use handle cover refill cartridge(s) is typically driven by the gear train or assembly (e.g., via a worm or standard gear). That is, the supply or feed section of the dual-use handle cover refill cartridge(s) typically is not driven. For example, referring briefly to FIG. 6, the spool or core that is used to contain and supply a continuous material of handle cover material typically is not in fixed relation, and therefore not driven, by the gear train. Stated another way, the take-up or collection section typically serves to pull the bag from the supply section. Still, other arrangements are contemplated and considered within the scope of the invention.

Figure 7:
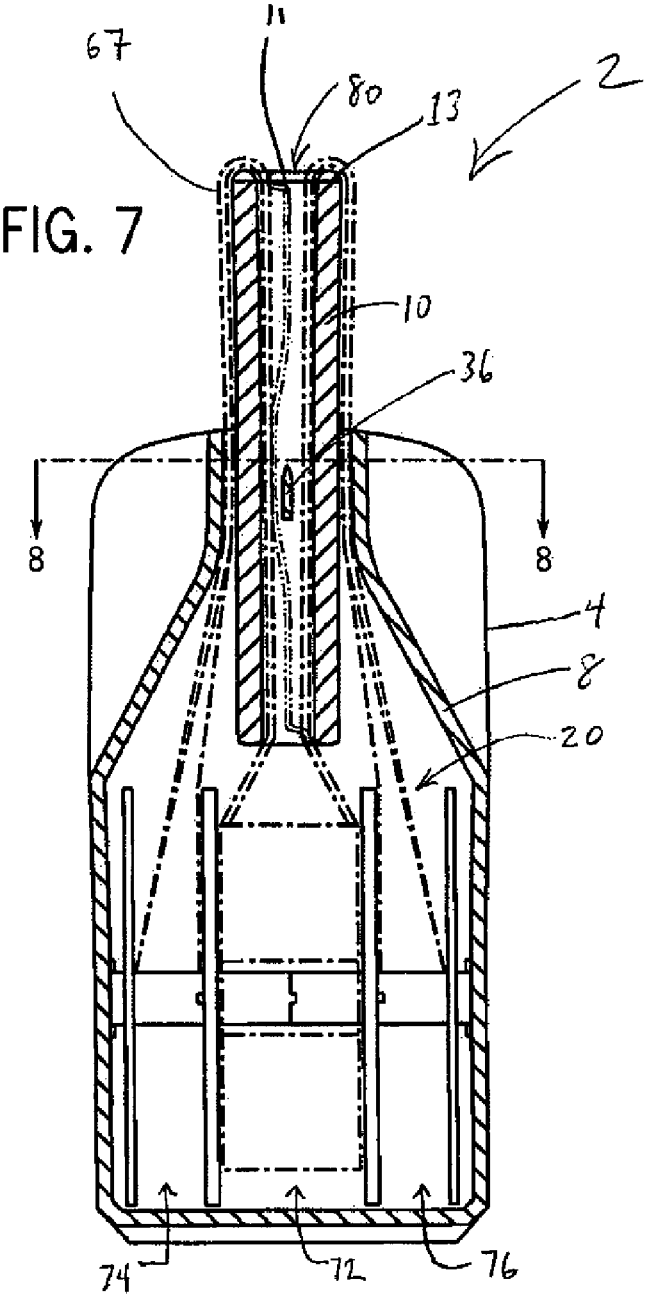
FIG. 7 is a schematic cross-sectional view of the automatic handle cover dispenser showing handle cover material installed and the dispenser ready for use according to one aspect of the present invention.

FIG. 7 is a schematic cross-sectional view of the automatic handle cover dispenser 2 with handle cover material 67 (shown in phantom). The handle cover material 67 is installed and ready for dispensing in accordance with one aspect of the present invention. More specifically, the dual-use handle cover refill cartridge 20 is shown installed within the housing 4, and contained within (or partially within) the secondary housing portion 8, of the dispenser 2. The cartridge 20 again is shown to comprise a first supply portion 72 and a pair of take-up portions 74 and 76 as previously described above. Again, the handle cover material 67 of the present embodiment is a continuous supply of tubular sleeve-like material that is used to overlay a handle, such as handle 10 of the dispenser 2.

In accordance with one aspect of the present invention, installation of the handle cover material 67 can be accomplished in the following manner: the handle cover material 67 is supplied (i.e., unwound) from the supply portion 72 of the cartridge 20 and fed, passed or extended (as shown in an upward direction) through an interior 80 of the handle 10. Handle slot 11 of handle 10 facilitates such passing through the handle to an area exterior of the dispensing 2 (as well as exterior of the handle as shown). Upon passing through the handle 10 and over its top end 13, the material is turned inside out. By exposing the interior of the bag-like material to a user (i.e., as the user grasps the handle) a maximum sanitary experience is ensured for a user using the handle 10. Once exterior of, and thus in overlay relationship with, the handle 10, the handle cover material is then passed back into the handle portion 8 of housing 4 of the dispenser 2. Next the continuous material of 67 is passed over a cutter that cuts the handle cover material at two points such that the material can be collected on the take-up portions 74, 76 of the cartridge 20 as is generally shown. The handle covers 67 are now installed within the device.

In these and in other embodiments of the invention, when the dispenser is to be used (i.e., once the handle cover material is installed), a user can grasp the handle of the dispenser, thereby touching and grasping the handle cover material that overlays the handle. The dispenser is connected to a structure (e.g., a door). The user pulls (or pushes) the handle (as s/he would normally do) and accomplishes the end goal (e.g., opening the door, etc.). Once accomplished, the user releases the handle and handle cover material. The device, utilizing the electromechanical means (e.g., infrared, capacitance, etc.) automatically advances the handle cover material a predetermined amount. In this way, used or soiled handle cover material (that portion touched by the user) is returned and collected to the dual-use handle cover refill cartridge collection section(s) and the additional handle cover material is supplied from the supply section of the cartridge to the handle. This process is repeated until fresh handle cover material supply is depleted, at which point the device will indicate such depletion is imminent or has occurred. The cartridge that is depleted of fresh handle cover material supply and associated cartridge parts are removed and can be recycled, and subsequently replaced with a new cartridge. The handle cover material itself can be designed to have multiple colors such that a color change is effected when the material within the device is nearing depletion and use logos for promotional purposes.

Figure 8:
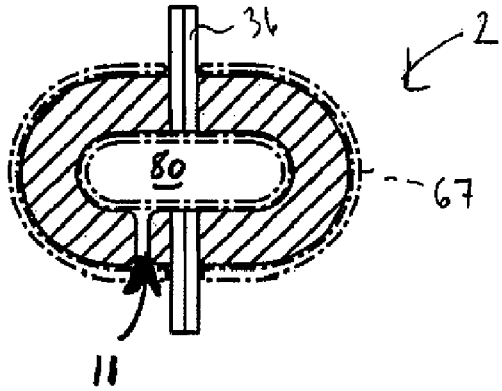
FIG. 8 is a cross-sectional view of a handle of the dispenser taken along line 8-8 of FIG. 7.

FIG. 8 is a cross-sectional view of the dispenser taken along line 8-8 of FIG. 7 illustrating the continuous material of handle cover material 67 installed and ready for use. Handle 10 includes a slot 11 that, as mentioned above, facilitates installation of the handle cover material 67. However, once installed, it can be seen that the handle cover material is entirely contained within the interior 80 of the handle 10 (and no longer within the slot). The material is passed over the top or open end (see FIG. 7) of the handle and the passed in overlay relationship with the exterior of the handle. As shown, in the present embodiment, a cutter 36 (as shown comprising a pair of cutting blades) is included to cut the handle cover material after they are passed over the exposed handle 10. The cutter 36 facilitates take-up or collection of the handle covers via the refill cartridge as previously described.

Figure 9:
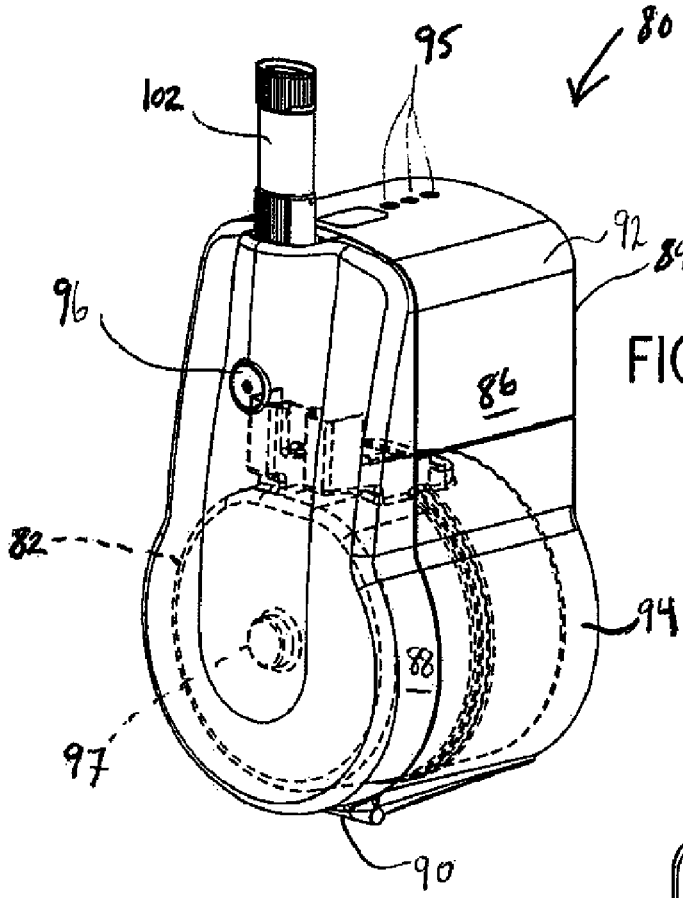
FIG. 9 is a perspective view of another embodiment of an automatic handle cover dispenser in accordance with another aspect of the present invention.
Figure 10:
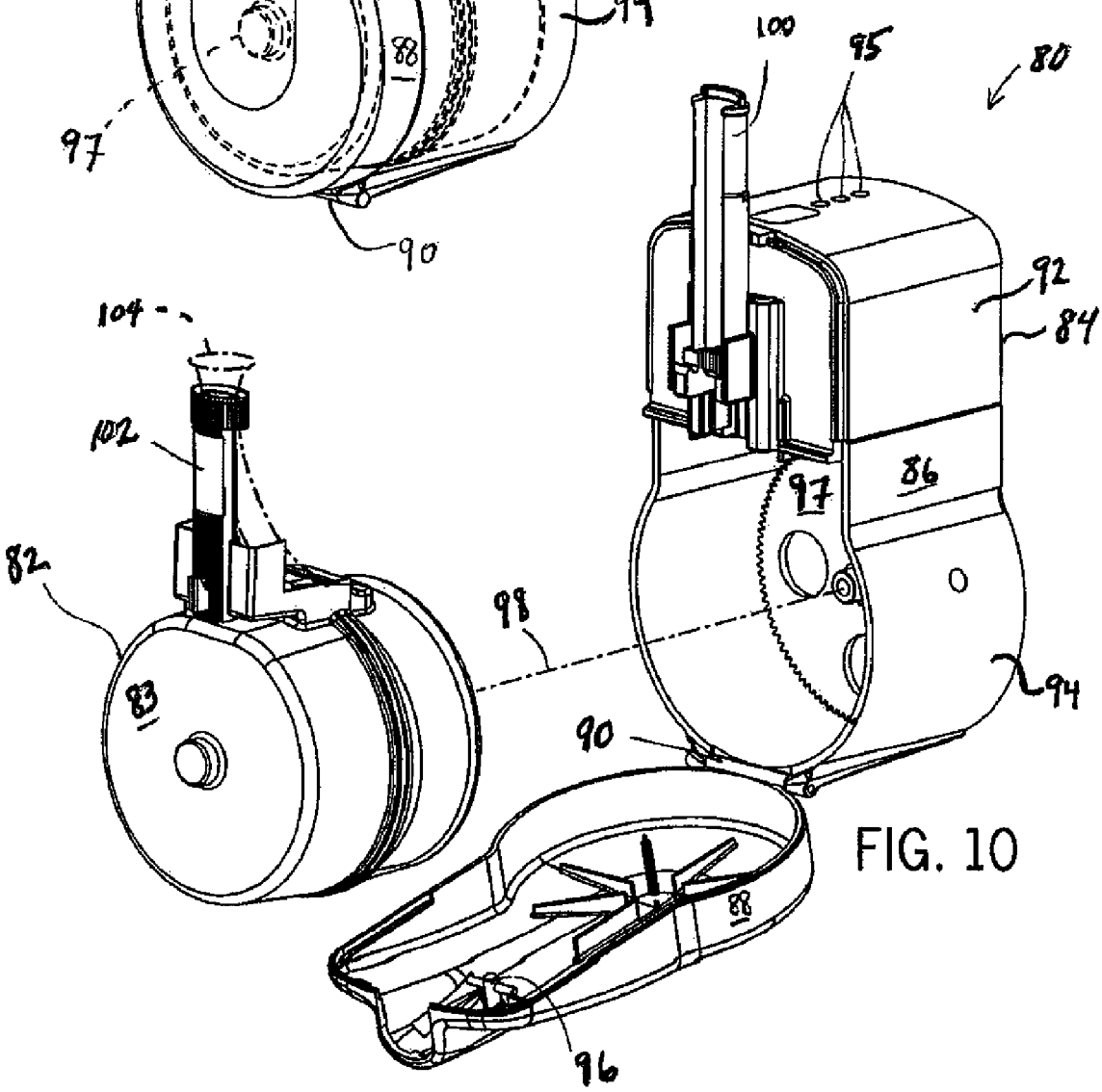
FIG. 10 is a partially exploded view of the automatic handle cover dispenser of FIG. 9 showing another embodiment of the dual-use handle cover refill cartridge in accordance with one aspect of the present invention.

FIG. 9 is a perspective view of another embodiment of an automatic handle cover dispenser 80 in accordance with one aspect of the present invention and FIG. 10 is a partially exploded view of the automatic handle cover dispenser of FIG. 9. FIG. 10 further illustrates a dual-use handle cover refill cartridge 82 for use in the present embodiment and in accordance with one aspect of the present invention.

Referring to FIGS. 9-10, the dispenser 80 includes a housing, generally referred to by the numeral 84. The housing 84 again contains or covers the internal electro-mechanical components of the dispenser 80, including the mechanical components for automatically dispensing a handle cover material, and the handle cover material itself (not shown). The housing 84 includes a main housing section 86 and a secondary housing section 88. The secondary housing section 88 pivots about hinge 90 to permit the housing 84 to be opened to access to its interior. The main housing section 86 includes a first section 92 and a second section 94 disposed adjacent the first section. The dual-use handle cover refill cartridge 82 includes a housing 83 (FIG. 10) which is sized and shaped to be received within the housing 84, and more particularly the main housing second section 94, of the dispenser 80. As noted above, in general, the dispenser housing 84 (and similarly the cartridge housing 83) has a shape that is contoured to efficiently cover and contain the internal automatic handle cover dispenser device components in an aesthetically pleasing fashion and it will be apparent to those of skill in the art that the shape of the housing 84 can vary to convenience without departing from the spirit and scope of the present invention, and that the invention should not be limited by any specific housing (or housing section, portion, etc.) shape. Also shown are holes 95 that are included to permit the viewing of indicator lights as described above (e.g., light-emitting diodes or "LEDs"), with such indicator lights used to indicate, by way of example, power on/off, and depletion of handle cover material or a device "low power" state. A lock 96 (viewable from an exterior perspective in FIG. 9 and from an interior perspective in FIG. 10) is included to fasten the secondary housing section 88 with respect to the main housing section 86 in secure fashion when the dispenser 80 is ready for use.

The automatic handle cover dispenser 80 is typically connected (directly or indirectly) to a door or other appropriate support substrate or structure, and it should be understood that the dispenser can be oriented in a manner that varies to the convenience or needs of the user as noted above. Handle cover refill cartridge 82, as shown in the present embodiment is oriented about an axis 98 that is at an angle with respect to the structure (e.g., a door) to which the device 80 is to be secured. In one preferred embodiment, axis 98 is oriented substantially perpendicularly with respect to such a substrate, surface or structure (as opposed to parallel or substantially parallel as shown in the previous embodiment). Contained within the dispenser housing 84 is a refill cartridge drive gear 97 that is used to drive the dispensing and taking up of handle cover material (not shown) from and to the refill cartridge (when positioned within the interior of the housing). Significantly, in the present embodiment, drive gear 97 is in operational association with, but not a discrete part of, the refill cartridge 82. As shown, it can be seen that the gear can remain fixed within the dispenser housing 84 when the refill cartridge is removed and/or installed (e.g., during replacement following depletion of handle covers).

Referring to FIG. 10, the dispenser 80 further includes a permanent, substantially permanent or semi-permanent handle core 100 (FIG. 10) that is connected to housing 84. Handle core 100 receives a handle overlay 102, through which handle cover material 104 (shown in phantom in FIG. 10) is dispensed from (and returned to) dual-use handle cover refill cartridge 82. It is contemplated that the handle overlay 102 will be made from an inexpensive, and yet durable material (e.g., plastic), and handle core 100 will be made from a more resilient and strong material (e.g., filled plastic, metal). In this manner, handle core 100 can serve to protect and provide structure for (and therefore minimize or eliminate breakage of) the handle overlay 102 during use by a user (the user will typically grasp, or substantially grasp, only the handle core 100). The "handle overlay" can also be termed a "handle cap" or "handle condom".

Figure 11:
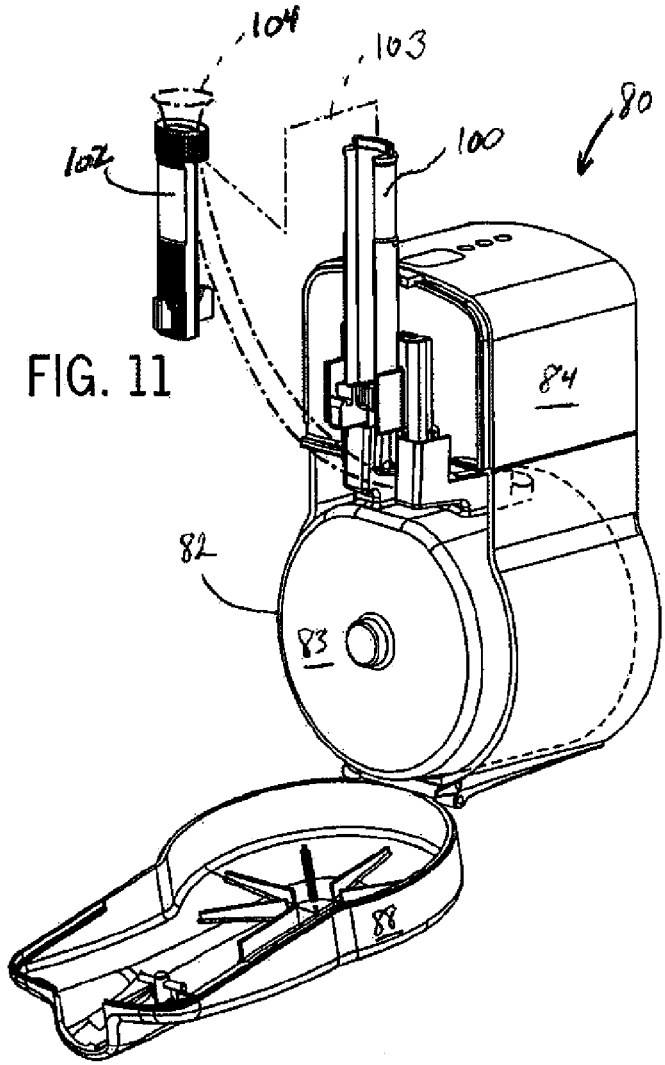
FIG. 11 is a partially exploded view of the automatic handle cover dispenser of FIG. 9 with the dispenser shown in an open position, the dual-use handle cover refill cartridge inserted into the dispenser, and further illustrating handle placement and/or attachment with respect to the housing, as well as handle cover installation, in accordance with at least one embodiment of the present invention.

FIG. 11 is a partially exploded view of the automatic handle cover dispenser 80 of FIG. 9 with the dispenser, and more particularly housing portion 88, shown in an open position. The dual-use handle cover refill cartridge 82 is now shown inserted into the dispenser 80, and in particular is shown positioned within the housing 84. Again, handle core 100 is shown extending or protruding from housing 84. To ready the automatic handle cover dispenser for use, handle cover material 104 (shown in phantom) is dispensed from the handle cover refill cartridge 82 and passed through the handle overlay 102 as illustrated. The handle overlay 102 is then placed and secured with respect to the housing 84, and more particularly the handle core 100 as indicated by dashed line 103 as shown, and in accordance with at least one aspect of the present invention. Thus, at installation, the handle cover material, as shown, is drawn to the front portion of the cartridge 82 (corresponding to the take-up or collection section as referenced below) and then the front cover 83 of the dual-use handle cover refill cartridge is closed (e.g. snapped). In this fashion, the handle is secured and ready for use by a user. In a preferred embodiment, handle overlay 102 is shaped to mimic the shape of the handle core 100 so as to promote a secure fit between the two items. The handle cover material 104 of the present embodiment again typically takes the form of a sleeve or bag made from a plastic or plastic-like material, although the invention should not be limited to a particular type or variety of such handle cover.

Figure 12:
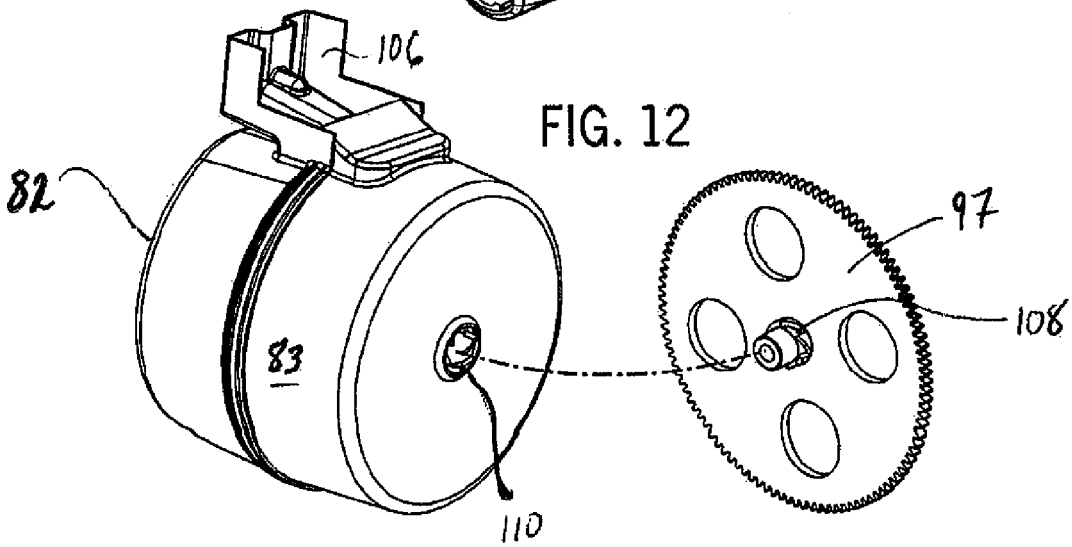
FIG. 12 is an enlarged partially schematic view of the dual-use handle cover refill cartridge for use with the dispenser shown in FIG. 9.

FIG. 12 is an enlarged partially schematic view of the handle cover refill cartridge 82 for use with the embodiment of the dispenser 80 shown in FIGS. 9-11, along with a drive gear 97 which is used to drive the dispensing and/or collection of handle cover material from and to the refill cartridge 82. Referring to FIGS. 11-12, the dual-use handle cover refill cartridge includes a cartridge housing 83 and a handle-cover extension 106 that extends from the cartridge housing 83 and receives the handle overlay 102 (FIG. 11). Handle-cover extension 106 further serves to guide handle cover material 104 (FIG. 11) from the cartridge 82 into the handle overlay 102 (FIG. 11) in a manner that prevents or substantially prevents jamming or snagging of the handle cover material (which again may take the form of a continuous material of sleeves or bags). Significantly, drive gear 97 mates with a cartridge 82 to accomplish supply and taking up of handle cover material via corresponding drive gear and cartridge mating notches 108 and 110, respectively. Importantly, the drive gear 97 of the present embodiment is in operational association with the refill cartridge.

Figure 13:
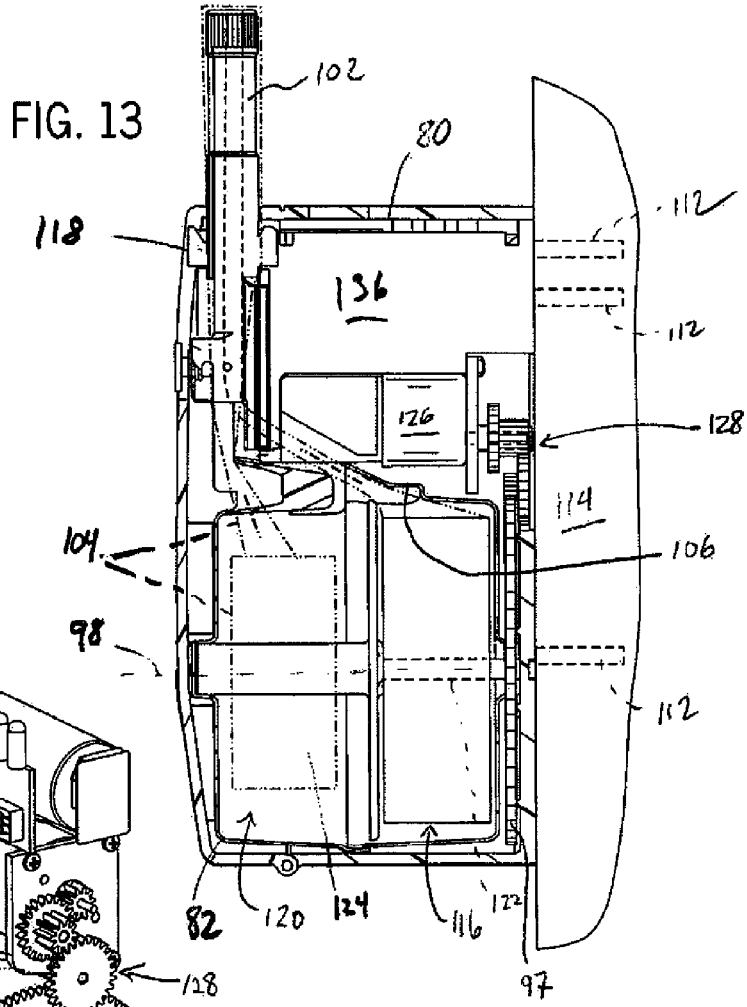
FIG. 13 is a partially schematic cross-sectional view of the dispenser illustrated in FIG. 9 showing handle covers installed and ready for use.
Figure 15:
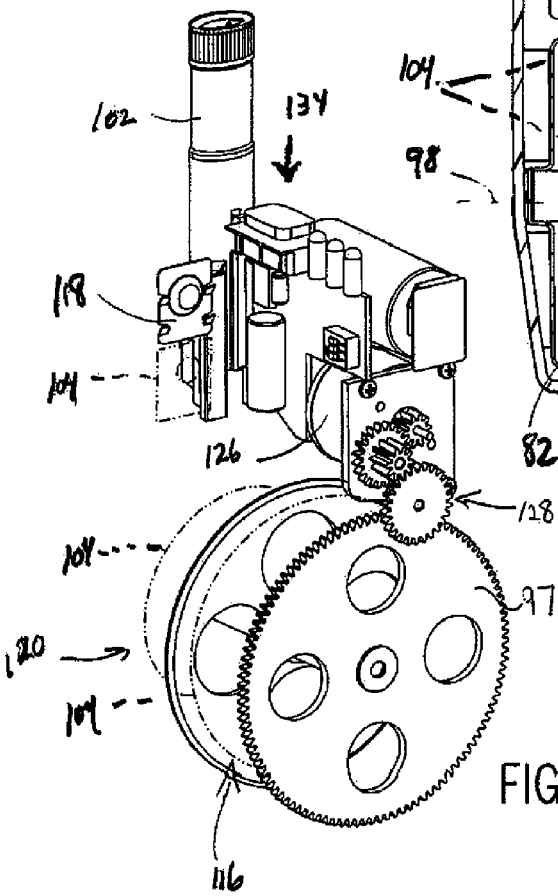
FIG. 15 is a partial front perspective view of various internal components of the dispenser of FIG. 13 (with the dispenser housing removed)

FIG. 13 is a partially schematic cross-sectional view of the dispenser 80 illustrated in FIGS. 9-11 showing handle cover cartridge 82 installed and ready for use and/or in use. FIG. 15 is a back perspective view of a portion of the dispenser 80 of FIG. 13 with the housing (and cartridge cover) removed to further illustrate various internal components of the dispenser. Referring to FIGS. 13 and 15, the dispenser 82 is secured, for example, via screws or other fasteners 112 (shown in phantom), to a support structure 114. Contained within the dispenser 80 is handle cover material 104 (shown in phantom). The handle cover material 104 is supplied from a dual-use handle cover cartridge supply section 116, and as noted previously with respect to FIG. 11, the handle cover material then extends via handle-cover extension 106 to and through handle overlay 102, and then over and about the handle overlay. As best shown in FIG. 13, the handle cover material comprises a continuous sleeve. Once exterior of the handle overlay 102 and the dispenser 80 (i.e., at or near a top end of the handle overlay), the material is turned inside-out and then extends in overlay fashion so as to provide a sanitary surface (as described above) with respect to the handle overlay and the handle core.

Still referring to FIGS. 13 and 15, the handle cover material 104 extends, and is returned to, the interior of the dispenser 80, where it is passed over a cutter 118 (e.g., a blade) and then to handle cover cartridge take-up or collection section 120 located within the handle cover cartridge 82. Cutting the handle cover material facilitates collection of the used and potentially soiled handle cover material. In a preferred embodiment, the cutter can comprise a blade as described above. The dual-use handle cover cartridge supply and take-up sections 116, 120 include supply and take-up spools 122, 124 respectively, about which handle covers 104 are unwound and wound. Drive gear 97 is also shown. Drive gear 97 is in operational association with the handle cover cartridge 82, and more particularly supply and take up spools 122, 124, to effect automatic supply of handle cover material 104 from the cartridge, as well as automatic collection of the used handle covers 104 to the cartridge. The drive gear 97 is driven by a motor assembly 126 similar to or the same as that described above which via a gear train, generally referred to by the numeral 128. It is of note that the worm gear referred to above is no longer necessary. This results from orientation of the handle cover cartridge 82 with respect to the support substrate or structure 114. More specifically, and as noted with respect to FIG. 10, supply and take-up (i.e., via unwinding and winding), respectively, of the handle cover material 104 occurs along an axis that is oriented perpendicular (or substantially perpendicular) with respect to the structure 114. It is notable that, because the dual-use handle cover cartridge can accomplish or accommodate both supply and collection of handle covers, it can be termed a "dual-use" handle cover cartridge. As noted above, electromechanical components effecting electronic control and powering of the automatic handle cover dispenser 80 of the present embodiment occurs using generally known components (e.g., batteries, PCB, LED's, IR sensors, etc.). Such components are typically positioned within the interior space 136 (FIG. 13) of housing 84.

Figure 14:
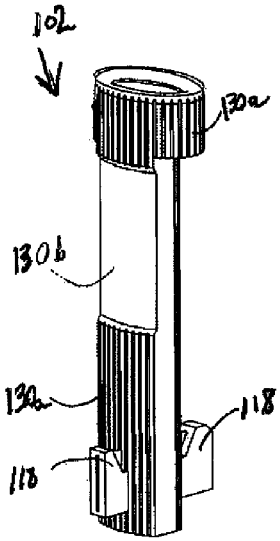
FIG. 14 is an enlarged perspective view of one embodiment of a handle overlay capable of being used with the automatic handle cover dispenser of FIG. 9 in accordance with at least aspect of the present invention.

FIG. 14 is an enlarged perspective view of one embodiment of the handle overlay 102 for the automatic handle cover dispenser 80 of FIG. 9 in accordance with at least one aspect of the present invention. As can be seen, the handle overlay 102 is generally contoured for ease of gripping by a user and to optimize the passing of the handle cover; furthermore, it should be understood that while the handle overlay is generally tubular and includes a generally elliptical cross-sectioned upper end, its shape can vary to convenience. Additionally, the exterior of the handle overlay 102 includes both textured (e.g., ridged) and non-textured regions, 130*a-b*, respectively, with these regions facilitating smooth movement (e.g., by reducing friction and static) of the handle cover material (see FIG. 11) over and about the handle. As described with respect to FIG. 13, the handle overlay 102 further includes a pair of cutters (e.g., cutting blades) 118 to effect slicing of the handle cover material following use and prior to collection by the take-up spool within the cartridge. In the present embodiment, it is contemplated that handle overlay 102 is replaceable and/or recyclable and thus typically made of a less rugged or durable material as compared to more permanent or semi-permanent handle core 100 (FIG. 11). The dispenser 80 further includes a sensor (e.g., a wave, infrared sensor, or capacitance) located proximate the handle which can respond to motion and so as to trigger the movement (i.e., automatic advancement) of handle cover material following use and this feature is also shown in various other Figures.

In general, in the above and other embodiments of the invention, one or more object detection sensors (e.g., infrared, motion or capacitance sensors) and other devices can be used to advance the handle cover material. Such technology can be programmed with multiple IR ranges (e.g., distances of detection) and pulse rates (sample detection) so as to optimize a particular need for a particular environment. Furthermore, the devices can be programmed so that the IR advances the handle cover material only after a user exits the IR range (after use—automatic advancement of cover material occurs), or alternatively, programmed so that the user has to proactively activate the automatic advance of handle cover material prior to using the handle by maintaining the user's hand in view of the IR for a certain predetermined (and selectable) amount of time (typically referred to in industry as "wave"). These and other options can be programmed and selected, and thus, vary to convenience. For example, a switch (e.g., a dip switch) can be used to choose an optimal programming for material advancement. The object detection devices are contemplated to achieve automatic advancing of handle cover material. Other devices and associated programming of such devices is described herein which facilitates and/or assists in monitoring and/or measuring handle cover material supply (e.g., dosing of material).

Figure 16:
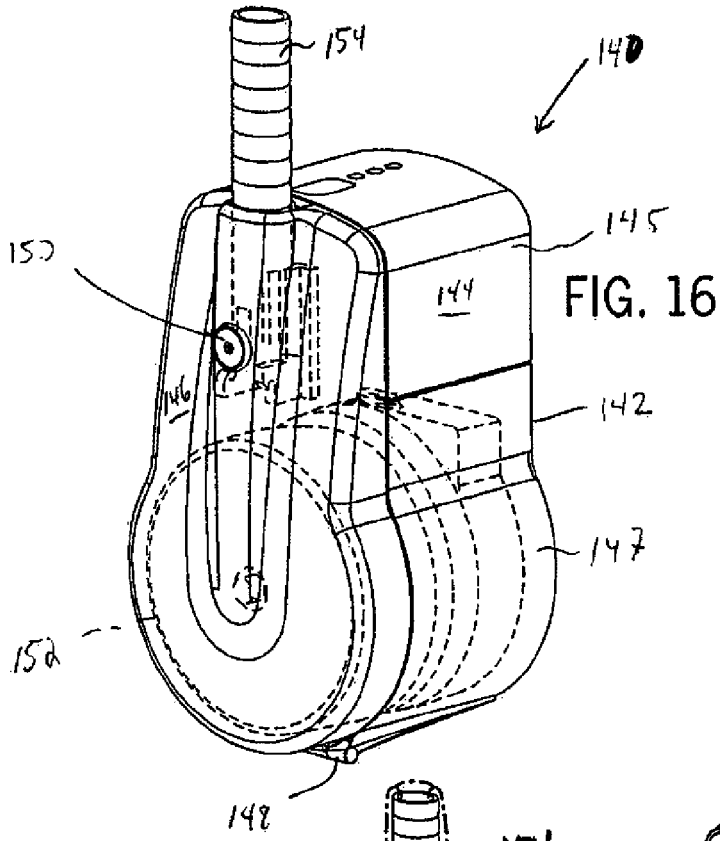
FIG. 16 is a perspective view of another embodiment of an automatic handle cover dispenser in accordance with another aspect of the present invention.

FIG. 16 is a perspective view of another embodiment of an automatic handle cover dispenser 140 in accordance with another aspect of the present invention. The handle cover dispenser 140 again includes a housing 142 that is similar to the housings of the previous embodiments. Namely, the housing 142 comprises a main housing portion 144 having main housing cover section 145 and a main housing second section 147. The housing further includes a cover portion 146, with the cover portion capable of being opened (so as to access the interior) and closed via rotation about hinge 148. When closed, the secondary cover portion 146 is capable of being locked via housing lock 150. Contained within the housing 142 is a handle cover refill cartridge 152 (shown in phantom) for supplying and collecting handle covers (not shown). Here again, the cartridge can be termed a "dual-use" cartridge. The cartridge can also be described as "recyclable" and "disposable". Handle cover material is again supplied to handle overlay 154 (and then generally encompasses the handle). Again, the housing is generally sized and shaped to contain the internal components of the dispenser, as well as the handle covers, but it should again be understood that the invention should not be limited to any particular housing design.

Figure 17:
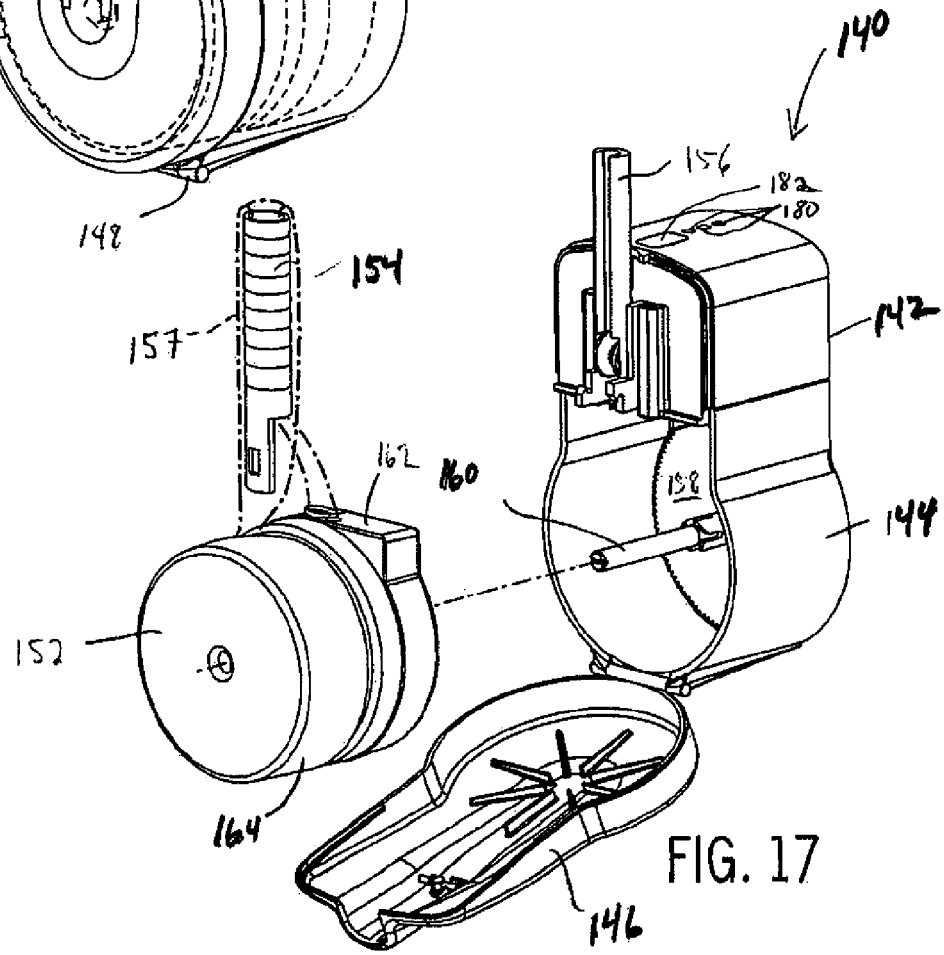
FIG. 17 is a partially exploded view of the automatic handle cover dispenser of FIG. 16, showing another embodiment of a dual-use handle cover refill cartridge, in accordance with one aspect of the present invention.
Figure 19:
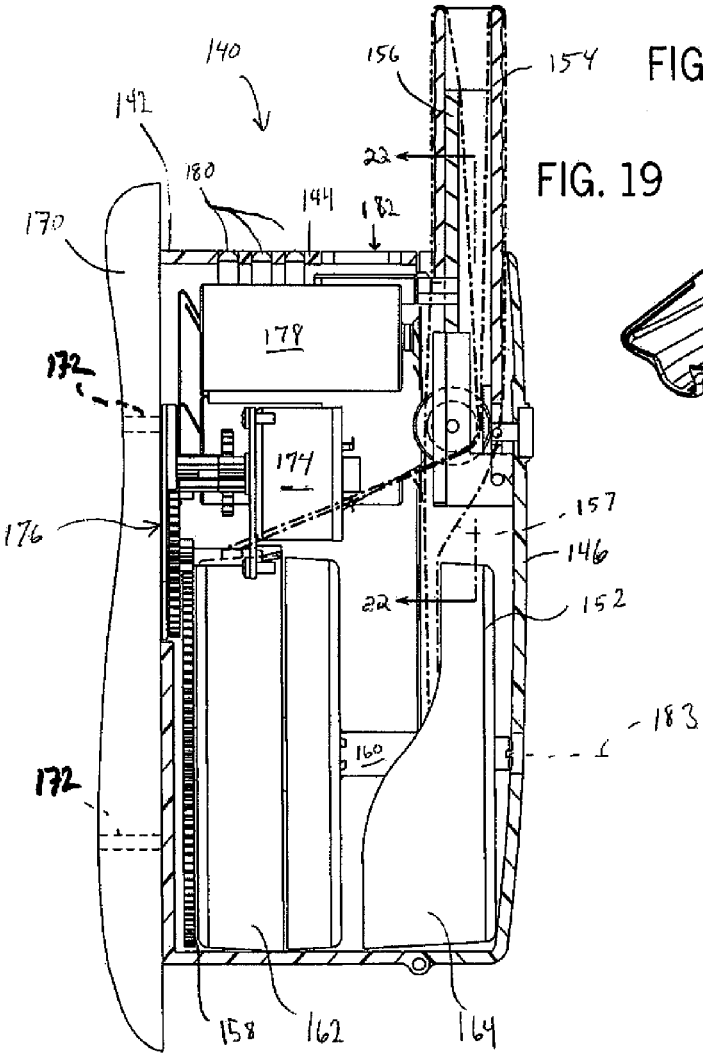
FIG. 19 is an enlarged partially schematic cross-sectional view of the handle cover refill cartridge capable of being used with the embodiment of the dispenser of FIG. 16.
Figure 18:
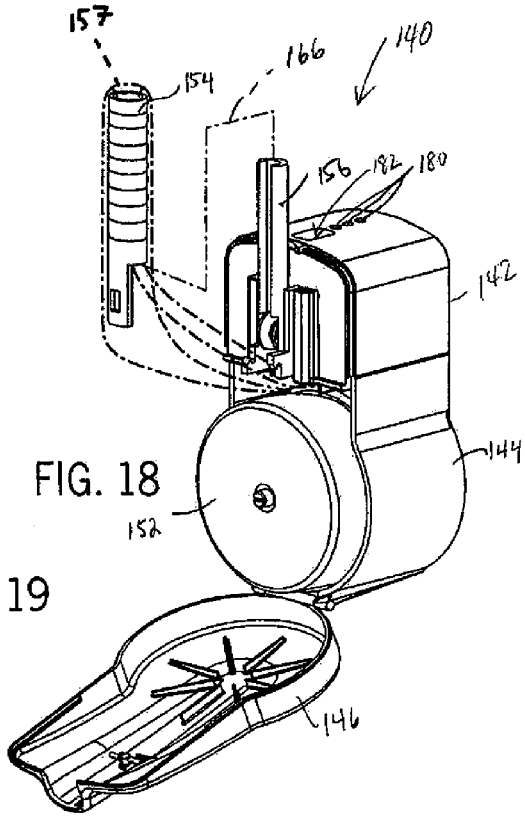
FIG. 18 is a partially exploded view of the automatic handle cover dispenser of FIG. 16 with the dispenser shown in an open position, with the dual-use handle cover refill cartridge inserted into the dispenser, and further illustrating handle overlay and handle cover placement and/or attachment with respect to the housing, as well as handle overlay and cover installation into the dispenser, in accordance with at least one embodiment of the present invention.

FIGS. 17-18 are partially exploded views of the automatic handle cover dispenser 140 of FIG. 16 showing the handle cover refill cartridge 152 and handle overlay 154, And FIG. 19 is an enlarged partially schematic cross-sectional view of the dispenser 140. In FIG. 17, the dual-use handle cover refill cartridge 152 is shown exterior of the housing 142, and in FIGS. 18-19, the cartridge is shown inserted into the dispenser housing. In FIGS. 17-18, the housing 142 is shown with the lockable cover portion 146 shown in an open position relative the main housing portion 144, and in FIG. 19, the lockable cover portion is shown in a closed position relative the main housing portion 144. Extending from the main housing portion 144 is a handle core 156. Handle core 156 is sized and shaped to conform to the handle overlay 154 such that it can receive and secure handle overlay 154 during use and/or operation of the automatic dispenser 140. As described above with respect to other embodiments, the handle cover material 157 generally comprises a continuous (i.e., connected) sleeve and is typically made of a plastic material that is preferably recyclable.

As best seen in FIGS. 17 and 19, disposed and secured within the housing 142 is a drive gear 158 which is used to drive the winding and unwinding of handle cover material 157 within the dual-use handle cover refill cartridge 152 via cartridge spool 160 (also referred to as an "axle" or "cartridge axel") to which it is connected and so as to effect supply and/or collection of the handle covers during use and/or operation of the dispenser. Dual-use handle cover refill cartridge 152 includes a supply section 162 from which handle cover material 157 is supplied to the handle over lay 154 as shown, as well as a take-up or collection section 164 into which handle cover material is collected following use.

Referring to FIG. 19 in particular, the dispenser 140, and more particularly the housing 142, is typically secured to a mounting structure 170 (e.g., a door) that is typically flat or substantially flat, and such securing or mounting is typically accomplished using known and readily available fasteners (e.g., screws). Motor assembly 174 is positioned within the housing 144 to move the drive gear 158 via a gear train assembly that is generally referred to by the numeral 176. The gear train 176 turns spool 160 and thus causes appropriate supply and take-up of the handle cover material 157. One or more batteries 178 power a motor assembly 174, and these batteries are also secured within the housing 144 as shown. Advantageously, spool 160 (or axle) rotates about an axis 183 that is at an angle with respect to the mounting structure 170, and in a preferred embodiment, the axis is perpendicular with respect to the structure.

Figure 20:
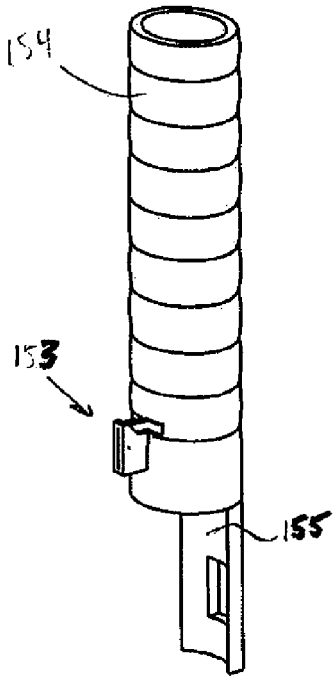
FIG. 20 is an enlarged perspective view of one embodiment of a handle overlay capable of being used with the automatic handle cover dispenser of FIG. 16 in accordance with at least one aspect of the present invention.

Referring again to FIGS. 17-19, the handle cover material 157 is installed as follows. Prior to the dual-use cartridge 152 being inserted into the dispenser 140, handle cover material is wound or provided within the supply section 162 of the cartridge 152. Handle cover material 157 is drawn from the supply section 162 of the handle cover refill cartridge 152 first to an interior of the handle overlay 154. The handle cover material is then pulled (as shown upwardly) over the top of the handle overlay 154 and exterior of the handle overlay such that it covers the handle overlay in inside-out fashion. The handle cover material 157 is then drawn to the collection section 164 of the cartridge 152 and affixed thereto (after being appropriately cut via cutter 153 as shown in FIG. 20). The cartridge 152 can then be positioned within the dispenser 140 over axle or spool 160. The handle overlay 154 is slipped on or otherwise positioned within the handle core 156 as illustrated by dashed line 166 after handle cover material is guided or inserted into the handle core 156. The handle cover material 157 can then be advanced or drawn through the handle and over its top end, but first, any slack in the material can be removed via automatically winding or unwinding of the cartridge spool 160. The handle cover material generally conforms to the size and shape of the handle. Here again, various aspects of the present embodiment can vary to convenience without departing from the scope of the present invention. For example, in these and other embodiments, the relative position of the supply and collection sections can be reverse or interchanged.

With regard to other components illustrated, batteries 178 also power LED's 180, which as described above, are used to identify various conditions, such as when the power is on/off, if the handle cover is used or sanitary (not used), the handle cover material 157 has been depleted or substantially depleted and re-fill is required. An infrared sensor 182, (e.g., capacitance, motion) is also included proximate the handle core 156 to accomplish automatic advancement of the handle cover material during use of the dispenser.

In one embodiment, the drive gear can include a profile that mates with a corresponding cartridge housing profile (e.g., one of the profiles can be a "male" and another can be "female"). In this manner, the dispenser can be "securitized" so as to ensure that only specific and/or desired cartridges are utilized as "re-fills". Moreover, the specific profiles or "key configurations" can be customer-specific and customer-variable, and thus, from one customer to the next. For example, with reference generally to FIG. 19, the security (lock-out) can be accomplished by mating a female profile (not shown) on a bottom of section 162 with a male rib (not shown) on a bottom of the dispenser housing 142, creating an interlock effect similar to that of a puzzle. There invention should not be viewed as limited in this respect to any particular "securitization" means.

Figure 22:
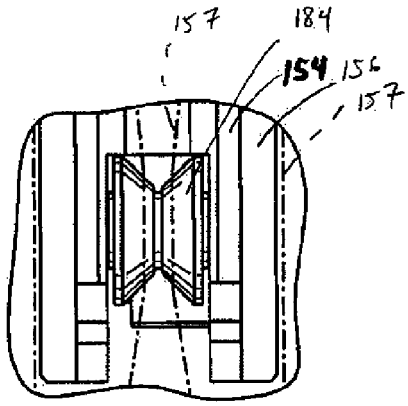
FIG. 22 is an enlarged view taken along line 22-22 of FIG. 19 illustrating a measurement and metering device capable of being used with the dispenser of FIG. 19 (as well as other embodiments), in accordance with one aspect of the present invention.

FIG. 22 is an enlarged view taken along line 22-22 of FIG. 19 illustrating a rolling measurement and metering device 184 positioned proximate the handle overlay 156 when the handle overlay 154 is slipped over the handle overlay during use and/or operation of the dispenser. The measurement and metering device 184 helps to guide handle cover material 157 (again shown in phantom) as the handle cover material is drawn from the supply section of the cartridge (FIGS. 17-19) into the handle overlay 154 and handle core 156. The measurement and metering device 184 is in operational association with at least one sensing device, such as a magnetic sensing device or optical sensor (not shown), and the motor assembly (FIG. 19) to effect measuring and/or metering of a proper amount of handle cover material 157 during use of the device. The measurement and metering device 184 can function similar to an odometer by recording the amount of handle covers dispensed, and thus it can serve to identify how much handle cover material to advance for a new sanitary use to identify when the supply of handle covers 157 within the supply section of the cartridge require replacement and/or refill. Although the measurement and metering device 184 includes a roller system, it should be understood that other means for accomplishing metering and/or measurement (including means comprising mechanisms other than rollers) of the handle cover material and handle cover usage are contemplated and considered within the scope of the present invention.

Turning now to FIG. 20, an enlarged perspective view of one embodiment of a handle overlay 154 is for use with the automatic handle cover dispenser of FIG. 16 and in accordance with at least aspect of the present invention. The handle overlay is again contoured for ease of gripping by a user and to allow the handle cover to pass; furthermore, it should be understood that while the handle is generally tubular, its shape can vary to convenience. The handle overlay 154 further includes a cutter 153 to effect slicing of the handle cover material following use and prior to collection by the take-up spool within the cartridge. In the present embodiment, it is contemplated that handle overlay 154 is replaceable and/or recyclable and thus typically made of a less rugged or durable material as compared to more permanent or semi-permanent handle core 156 (FIGS. 17-19). The handle overlay further includes extension section 155 so that the handle overlay can interface with the handle core so that it cannot be removed when the dispenser cover is closed. The handle overlay as shown would be rotated 180 degrees so as to be oriented to be slipped over the handle core 156.

Figure 21:
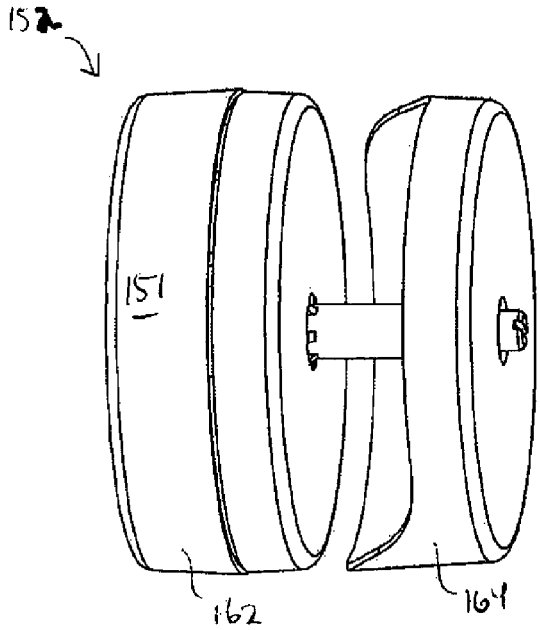
FIG. 21 is an enlarged view of the dual-use handle cover refill cartridge capable of being used with the embodiment of the dispenser shown in FIG. 16, with shape of the cartridge cover facilitating collection of handle cover material.

FIG. 21 is an enlarged view of the dual-use handle cover refill cartridge 152 shown, for example, in FIG. 18 for use with the present dispenser embodiment. Again, the dual-use handle cover refill cartridge 152 includes a housing 151 (a portion of which is removed) that defines an interior. The cartridge includes a supply section 162 from which handle cover material (not shown) is supplied, as well as a take-up or collection section 164 into which handle cover material is collected following use. Spool 160 interfaces with the drive gear previously described to supply and collect the handle cover material. The shape of housing 151, particularly the portion bounding the collection section 162, facilitates collection of handle cover material in an even manner, and thus, serves to optimize space within the collection section. Of course, the shape can be varied, and such variation is contemplated and considered within the scope of the present invention.

In general, with reference to the above-described embodiments for the dispenser, a user can grasp a dispenser handle, which typically takes the form of a strong handle core, and yet disposable handle overlay. When the dispenser is connected or otherwise secured to a supporting structure such as a door, the handle will permit a user to open the door. Using one or more sensing technologies, automatic advancing of handle cover material is effected after release of the handle (or handle overlay) by a user. Also, a handle cover material can be advanced automatically via one or more sensors, and user movement (e.g., hand movement) can activate such sensor(s). Handle cover advancement is driven by a battery-powered motor assembly that itself is housed within the dispenser (along with the one or more batteries). Sensor or switch technology is used to meter and/or measure appropriate dispensing of the handle cover material, with the amount dispensed (or collected) depending on a number of variables, including: 1) dispenser and dispenser component size; 2) handle cover material type and thickness; 3) size (e.g., length, diameter, etc.) of the handle core and handle overlay to be covered; and number of uses desired prior to exhaustion or depletion of the handle cover supply. Advantageously, the dispensers are secured to or mounted in virtually any desired orientation to promote dispensing of handle covers. Moreover, the dispenser housing is lockable, making re-filling easy to accomplish while minimizing the threat of tampering with internal dispenser contents and/or components by other than desired personnel.

As noted previously, the dispenser housing can be sized and shaped to convenience. Similarly, the handle can be sized and shaped to convenience. For example, the handle can be extended for use in various applications. The automatic handle cover assembly is contemplated for use applications other than door handles. For example, it is contemplated that the above-described dispenser can be used in various end-use applications, including handles that are found on shopping and other carts. The housing itself can be made from a variety of materials. In one embodiment, the housing can comprise a black, and yet translucent, material, and in another embodiment, the housing can comprise a metallic (e.g., chrome, metal) material. While it is contemplated that the housing can be made of a single material, it is also contemplated that one or more materials might be used to construct one housing section, a different material might be used to construct another of the housing sections (e.g., the main housing section might be made of plastic, while a secondary housing section might be made of chrome or metal).

Figure 23:
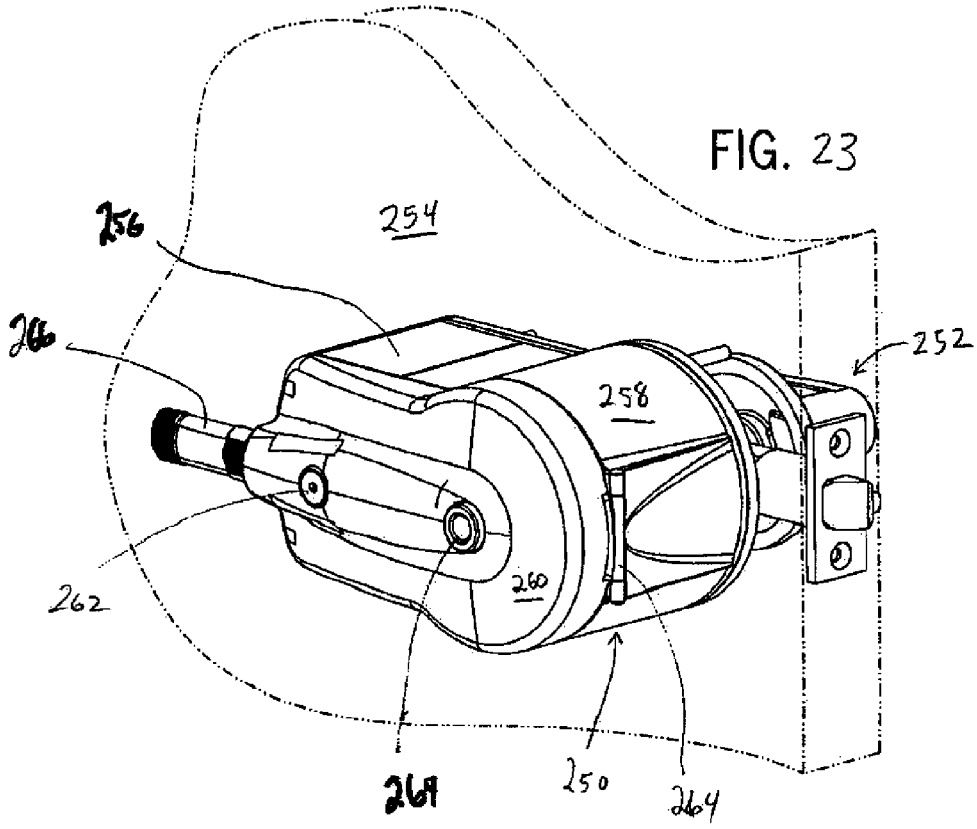
FIG. 23 is a front perspective view of another embodiment of an integrated automatic handle cover dispenser and lockable door handle shown in accordance with one aspect of the present invention.
Figure 24:
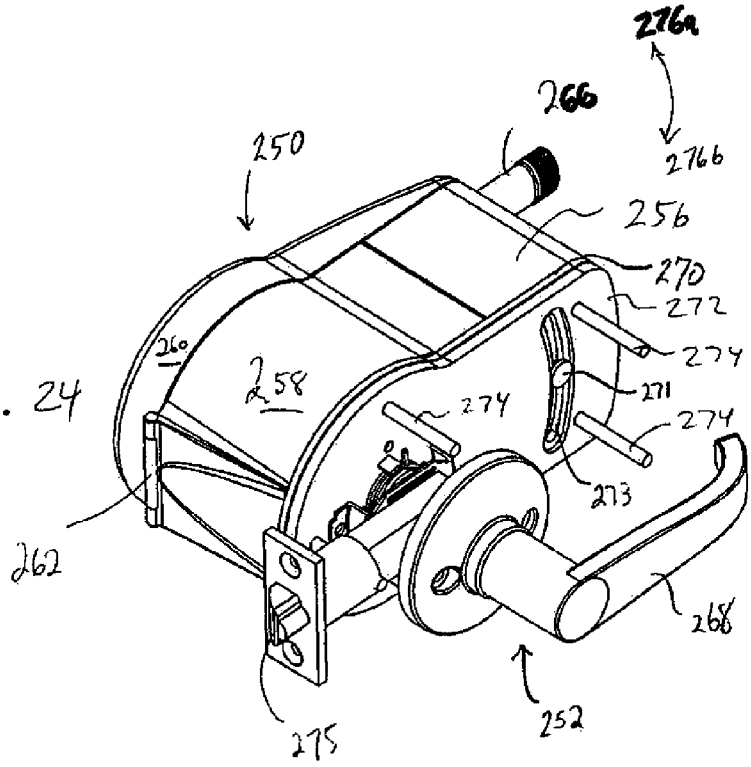
FIG. 24 is a rear perspective view of the integrated automatic handle cover dispenser and lockable door handle shown in FIG. 23.

FIG. 23 is a front perspective view of another embodiment of an automatic handle cover dispenser 250 for use with a lockable door handle assembly, generally referred to by the numeral 252, in accordance with one aspect of the present invention. FIG. 24 is a rear perspective view of the automatic handle cover dispenser 250 for use with a lockable door handle 252 assembly. FIG. 25 is a front view of the dispenser 250 with the dispenser connected to a door 254 (shown in phantom). And FIG. 26 is a partially schematic cross-sectional view of the automatic handle cover dispenser 250 for use with a lockable door handle assembly 252 taken along line 26-26 of FIG. 25.

Referring to FIGS. 23-26, the dispenser 250 is a dispenser of a kind that was already described above with reference to the embodiment of FIGS. 9-15, and as such, the internal components of the dispenser will be described only as necessary to facilitate an understanding of the present embodiment. It should be understood, however, that the embodiments of FIGS. 1-8 and FIGS. 16-22 could also be used with regard to such a lockable door handle and the present invention should not be limited by the illustrations or description here. Moreover, the variations contemplated and considered within the scope of the present invention as described or shown with respect to the aforementioned embodiments of the dispenser should be considered applicable (or substantially applicable) to the present embodiment.

Referring to FIGS. 23-25, the dispenser 250 includes a housing 256 having a main housing section 258 (not shown in FIG. 25) and a secondary housing section 260 which can be opened by unlocking the secondary housing section lock 262 (not shown in FIG. 24) and rotating the section about hinge 264. A dispenser handle 266 again protrudes from the housing 256, and more particularly from the secondary housing section 260. A standard lockable door handle 268 (FIG. 24) having a lock 269 (FIGS. 23 and 25) is also shown. A dual-use supply and take-up handle cover cartridge 267 is shown in phantom in FIG. 25. The cartridge is sized to accommodate the lock 269, as indicated by dashed line 265, and as described below with reference to FIG. 26.

Referring to FIGS. 24 and 26, housing 256, and more specifically the main housing section 258, of dispenser 250 is connected to a pivot plate 270. Plate 270 is in sliding relationship with fixed plate 272, which in turn is fastened or otherwise secured to door 254 (or other surface) via fasteners (e.g., screws) 274. More specifically, first plate 270 includes interlocking tabs (not shown) that mate with plate 272 to allow for rotation of the dispenser 250 during locking and unlocking of the door handle assembly 254. In addition, plate 270 is connected to fixed plate 272 via a stud 271 (e.g., a stop stud or threaded stop stud.) that can slide within a groove 273 (the stud and groove are shown in FIG. 24). More specifically, plate 270, and thus the dispenser 250 itself (which is secured to the pivot plate), can slide with respect to the fixed plate 272, and thus the door 254 (which is connected to the fixed plate), as indicated by arrows 276*a-b* when the handle 266 (FIG. 24) of the dispenser is pushed in the corresponding direction. Such movement of the dispenser (rotational movement) caused by pushing or pulling on the handle 266 ultimately causes retraction of latch mechanism 275 such that the door can be opened or closed. In one embodiment, the first and second plates are sized and shaped to conform to the size and shape of the dispenser.

Referring to FIG. 26, various internal components of the door handle dispenser 250 and locking door handle 252 are illustrated. By way of example, and as noted earlier, the dispenser again includes a motor assembly 280 that is used to drive, via a gear train that is generally referred to by the numeral 282, a drive gear 284. The drive gear 284 permits automated supply and take-up of handle cover material (not shown) from within the dual-use (i.e., supply and take-up) handle cover cartridge 267 (shown in phantom) as described above. Batteries 285 are again shown and serve various purposes as previously described. Significantly, cartridge 267 is designed to accommodate lock 269 (e.g., a "push-button type lock"), and more particularly spring-loaded plunger 286 (which passes through the cartridge). When the door is locked, rotation of the dispenser 250 in a direction corresponding either arrow 276*a* or 276*b* causes release of the spring-loaded plunger 286, thus unlocking of the door 254. A spring mechanism 288 (e.g., a torsion spring mechanism) is used to return the dispenser 250 to its original position (i.e., if the dispenser is pushed down to open the door, the spring mechanism lifts the dispenser backup). The embodiment of FIGS. 23-26 can be termed an "integrated dispenser and lockable door handle assembly".

Figure 27:
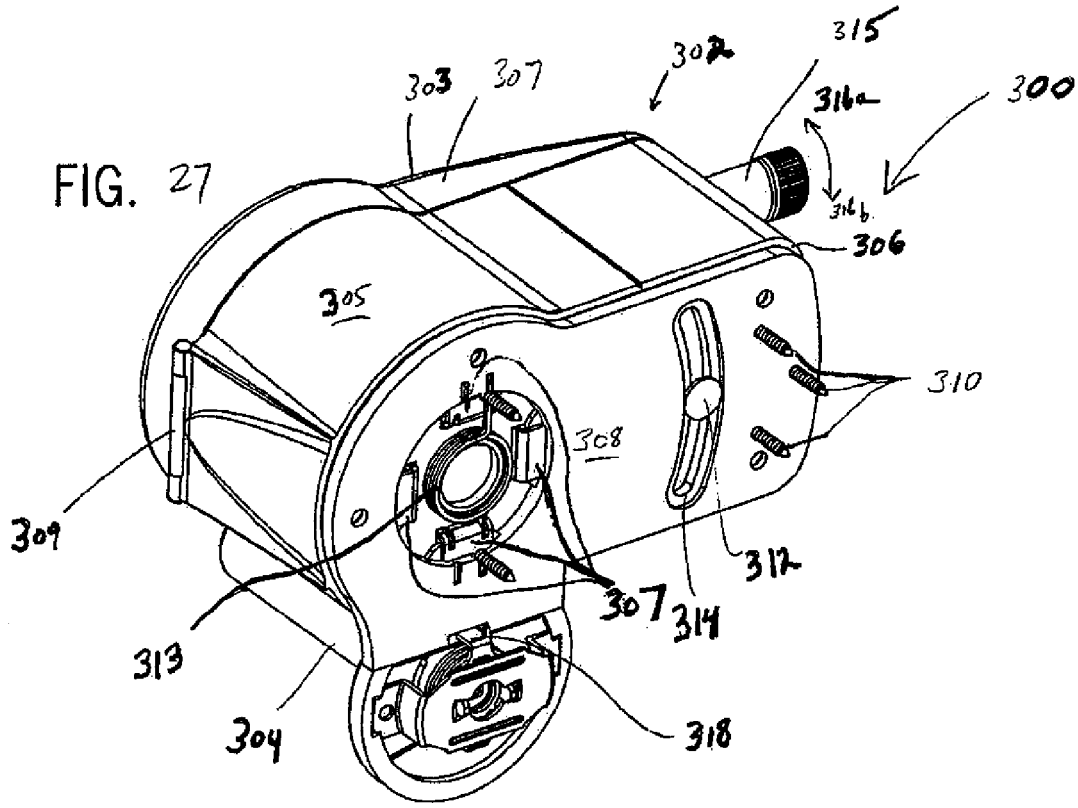
FIG. 27 is a rear perspective view of a partially integrated automatic handle cover dispenser and lockable door handle assembly in accordance with one aspect of the present invention.

FIG. 27 is a rear perspective view of a partially integrated automatic handle cover dispenser and lockable door handle assembly, with the overall assembly generally referred to by the numeral 300. The assembly 300 includes an automatic handle cover dispenser 302 and a standard lockable door handle assembly 304. As noted above, the dispenser can vary in accordance with the embodiments described above with reference to the Figures. (i.e., one embodiment of the dispenser can be substituted with another), however the dispenser of FIGS. 9-15 is illustrated exemplary fashion. Dispenser components and their functionality have been shown and described. Moreover, the lockable door handle assembly of the kind illustrated is generally known. The dispenser 302 includes a housing 303 having a main body portion 305 and a secondary cover portion 307. The secondary cover portion 307 can be opened and closed with respect to the main housing portion 305 via hinge 309 and can be secured via lock 311. (See FIG. 28).

Still referring to FIG. 27, in the present "partially integrated" assembly, the dispenser 302 can pivot or rotate with respect to the lockable door handle assembly 304 using a plate system similar to that described above. More specifically, the dispenser 302 is connected to a first plate 306. First plate 306 is in sliding relationship with fixed plate 308, which in turn is fastened or otherwise secured to door (not shown) via fasteners (e.g., screws) 310. To permit such rotation and relative movement, first plate 306 is connected to fixed plate 308 via a plate extension stud 312 (e.g., a threaded stop stud or stop stud) that can slide within a groove 314 in fixed plate 308. First plate 306 includes interlocking tabs 307 that mate with plate 308 to allow for rotation of the dispenser 302 during locking and unlocking of the door handle assembly 304. When a user pushes or pulls on handle 315 of the dispenser 302 in a direction corresponding to either 316*a* or 316*b*, the dispenser rotates because the first plate 306 slides via stud 312 with respect to the fixed plate 308. Movement of the dispenser 302 causes the pivot plate 306 to release a door mechanism 318, which in turn causes the door to unlock. A return spring mechanism 313 (again, for example, a torsion spring mechanism) causes the dispenser to return to its original position (e.g., if the dispenser is pushed in a direction corresponding to arrow 316*a*, the spring mechanism will cause the dispenser to move in a direction corresponding to arrow 316*b*).

Figure 28:
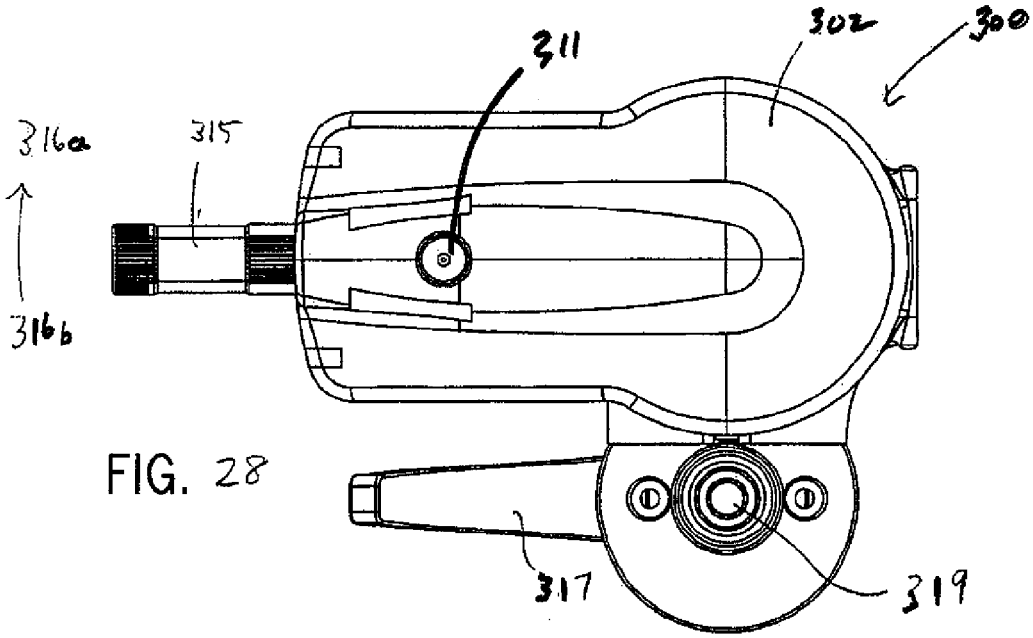
FIG. 28 is a front view of a partially integrated automatic handle cover dispenser and lockable door handle assembly shown in FIG. 27.

FIG. 28 is a front view of a partially integrated automatic handle cover dispenser and lockable door handle assembly 300 shown in FIG. 27. Again the overall assembly 300 includes an automatic handle cover dispenser 302 and a standard lockable door handle assembly 304. As can be seen, the door handle assembly 304 includes a handle 317 having a push-button lock 319. As described with reference to FIG. 27, movement of handle 315 in either of directions indicated by arrows 316*a* or 316*b* causes release of push button lock 319, and thus, unlocking of the door handle assembly 304.

FIGS. 29-30 are rear perspective and front views, respectively of an automated handle cover assembly 320 in accordance with one aspect of the present invention. The assembly 320 includes a handle cover dispenser 322 that is in operational association with a lockable door handle assembly 324, and in particular to handle 325, via a pair of plates 326*a-b*. The dispenser assembly can constitute a retrofit for use with a standard lockable door assembly. Dispenser 322 is again illustrated using the embodiment shown and described above with respect to FIGS. 9-15, but it should be understood that other embodiments are contemplated for use as part of the retrofit assembly and the retrofit assembly should not be limited to the drawings. Moreover, the internal components can vary as described previously. The dispenser 322 again includes a housing 328, and a handle overlay 330 that protrudes from the housing. Handle covers (not shown) are automatically dispensed from the dispenser as described above. The housing 328 includes a main body portion 332 and a secondary cover portion 334 (FIG. 29) that opens and closes with respect to the main housing portion via hinge 336 (FIG. 30) and can be secured via lock 337 (FIG. 30).

Referring to FIG. 29, the main housing section 332 of dispenser 322 is connected to a pivot plate 333 that is in pivoting relationship with a fixed plate 338, which in turn is fastened or otherwise secured to a door (not shown) via fasteners (e.g., screws) 340. More specifically, dispenser main housing section 332 is connected to a first plate that in turn is connected to fixed plate 338 via a stud 342. Stud 342 (e.g., a threaded stud) of first plate 333 can slide within a groove 344 of fixed plate 338. In addition, first plate 333 includes interlocking tabs 349 that mate with plate 338 to allow for rotation of the dispenser 322 during locking and unlocking of the door handle assembly. As such, when the handle 330 of the dispenser is pushed in a direction corresponding to arrows 346*a* or 346*b* (e.g., up or down), the dispenser 322, can slide with respect to the fixed plate 338 in a corresponding manner. Rotational movement of the dispenser caused by pushing or pulling on the handle 330 in turn causes plates 326*a-b* to move in a corresponding direction, since the plates are in abutting contact with the dispenser 322. And because the plates 326*a-b* are connected to the lockable door handle 325, movement of plates 326*a-b* causes the lockable door handle assembly 324 to unlock in a known manner. It is of note that, in the embodiment shown, unlocking of the lockable handle 325 occurs only when the dispenser handle 330 (or the dispenser itself) is moved in a direction corresponding to arrow 346*b* because plates 326*a-b*, as shown, are in abutting contact only with the dispenser 322. Finally, a spring mechanism 348 (e.g., a torsion spring) is used to return the dispenser 322 to its original position. That is, if the dispenser is pushed in a direction corresponding to arrow 346*b* to open the door, the spring mechanism moves the dispenser in a direction corresponding to arrow 346*a* when the dispenser handle is released.

Figure 31:
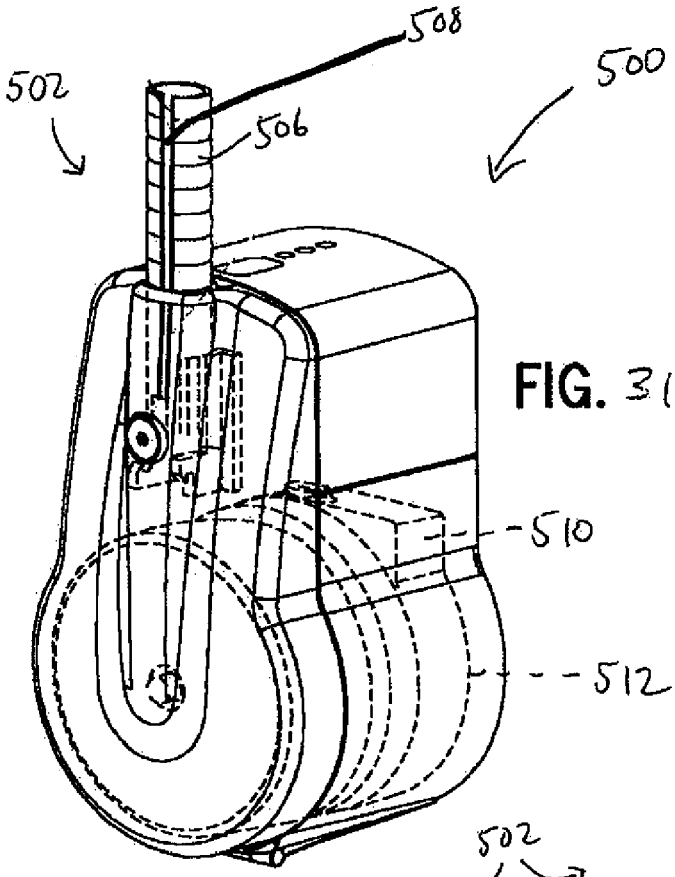
FIGS. 31 and 32 illustrate perspective views of the dispenser previously illustrated but showing replacement of damaged handle cover material and associated handle overlay detail.
Figure 32:
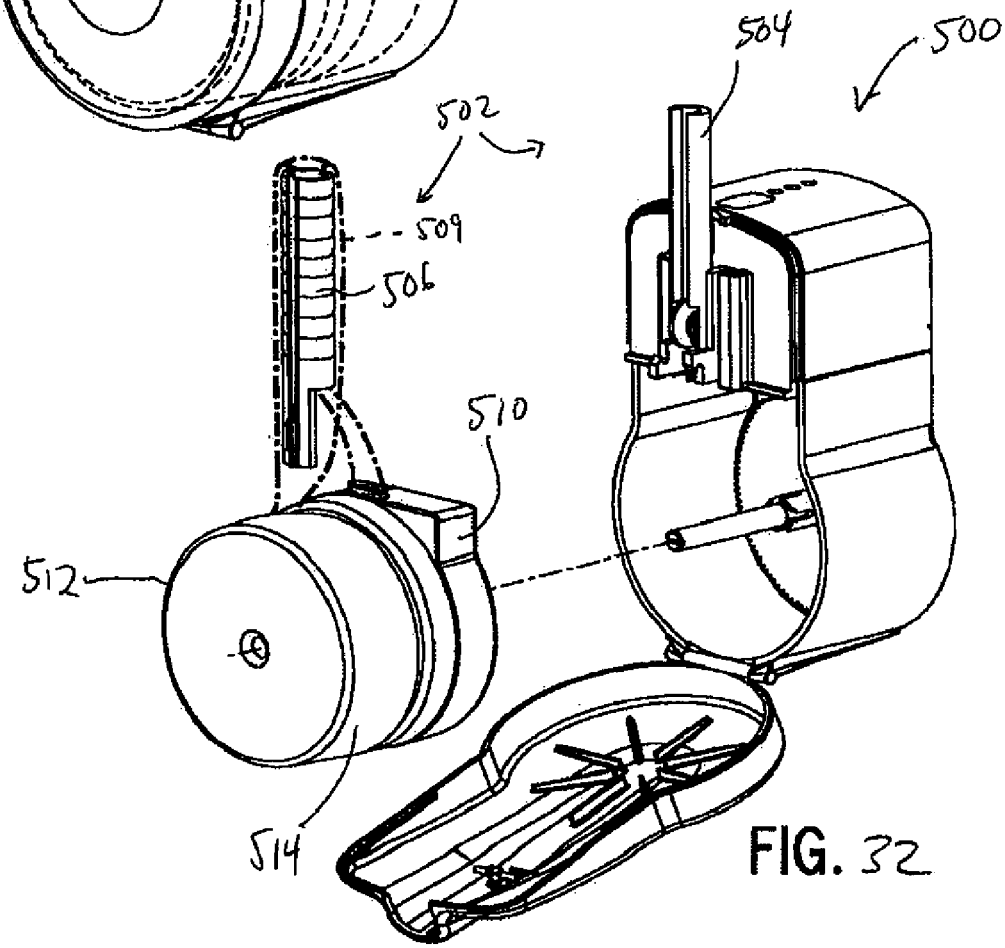

As an additional point, in one embodiment, fixed plate 338 is sized and shaped to conform to the size and shape of the dispenser 322. Also shown in FIG. 29 is a sensor 345 (e.g., infrared, capacitance, wave, etc.) that can be used to effect automatic advancement of handle covers (not shown) following use (i.e., user contact with handle overlay 330). FIGS. 31 and 32 again illustrate perspective views of an embodiment of the dispenser 500, again having a handle 502 comprising a handle core 504 and handle overlay 506, with a top-to-bottom slit or slot 508 formed in the handle overlay. Advantageously, the slot does not sacrifice (or substantially sacrifice) overall handle strength, since the handle overlay is received by a handle core. Again the handle core can be considered permanent and essentially serves to provide overall handle strength. However, the slot allows the servicing customer to replace the handle cover material 509 (e.g., when the handle cover is ripped or otherwise damaged for any reason, including vandalism). If the handle cover material is damaged, a servicing customer or other individual can simply open the dispenser (as described above) and pull the handle cover material from the supply section 510 of the cartridge 512 and subsequently pulls the handle cover material through (as shown upwardly) the handle overlay slit and handle core (which receives the handle overlay). As shown, at the top of the handle overlay, the material is turned inside out and pulled downwardly to the take-up or collection section 514 (this is applicable to any of the embodiments described herein).

The handle cover material is then affixed to the collection section (e.g., using tape or a small slit in the plastic housing to hold onto the material for the cartridge, etc.). Additionally, the dispenser is automatically advanced a few times to ensure the handle cover material winds onto the collection section appropriately. The dispenser is then closed and ready for operation. Although a particular embodiment of the dispenser is shown, any dispenser can be used.

Figure 33:
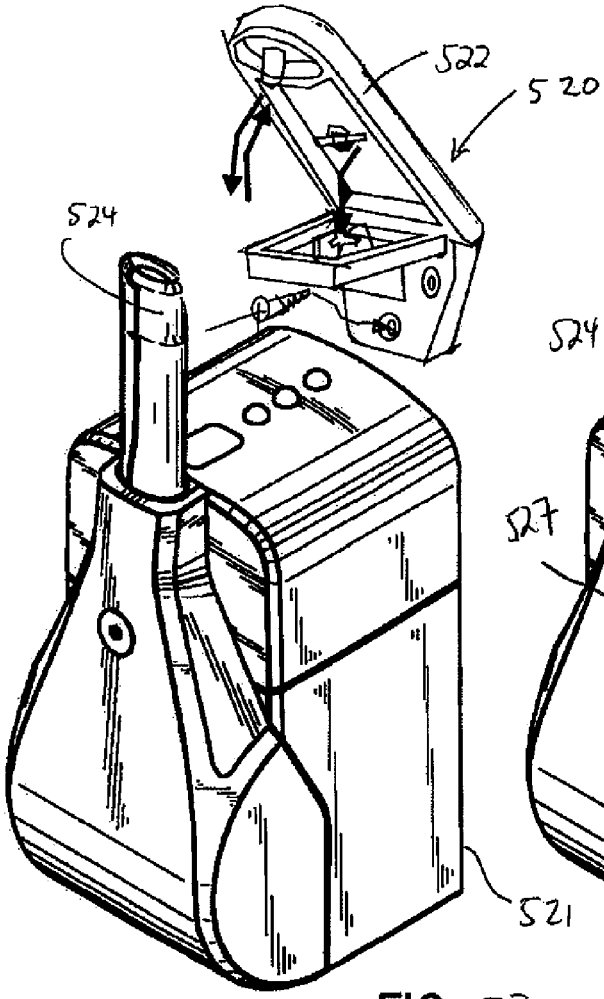
FIGS. 33 and 34 illustrate perspective views of one embodiment of a retrofit mechanism (accessory) that can be affixed to the structure to which the dispenser is attached (e.g., a door) and cover the top of the handle (i.e., the handle overlay and core as shown) so as to eliminate or substantially eliminate the introduction of objectionable materials into the dispenser or other related vandalism.
Figure 34:
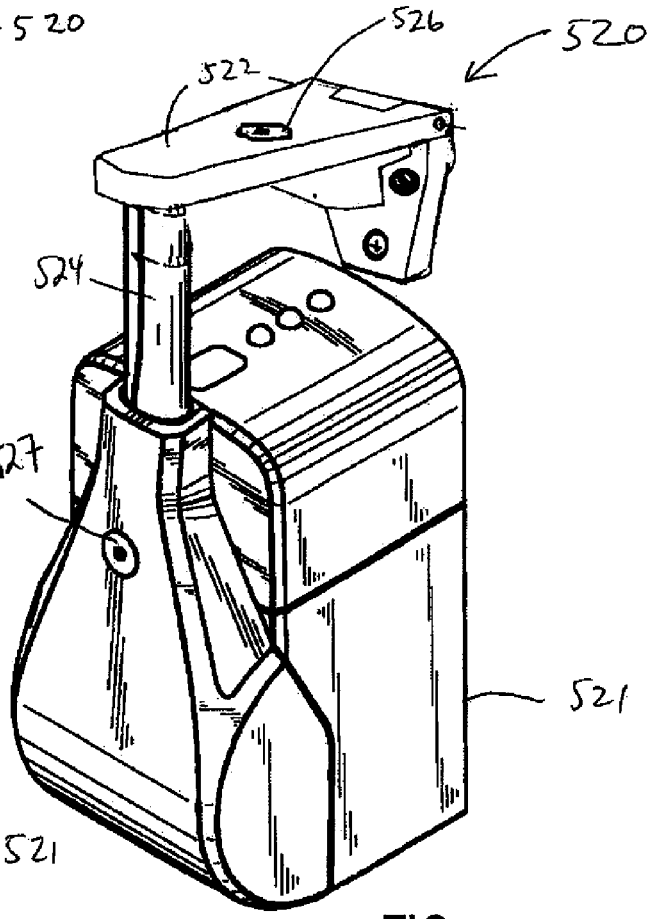

FIGS. 33 and 34 illustrate perspective views one embodiment of a retrofit mechanism 520 that can be affixed to the structure to which the dispenser 521 is attached (e.g., a door). An armature 522 covers the top of the handle 524 so as to eliminate or substantially eliminate introducing objectionable materials (e.g., cigarette butts, etc.) into the handle interior via the and allow for only the necessary amount of handle to be exposed for pulling/pushing. Furthermore, if handle 524 was to be pulled hard, the armature 522 can help prevent the breaking of the handle 524. The retrofit mechanism can also be locked via lock 526, with the lock being accessed, for example, using a key that is the same as (or similar to) a key that can be used to unlock the dispenser lock 527 as described previously. Although a particular embodiment of the dispenser is shown, any dispenser can be used.

Figure 35:
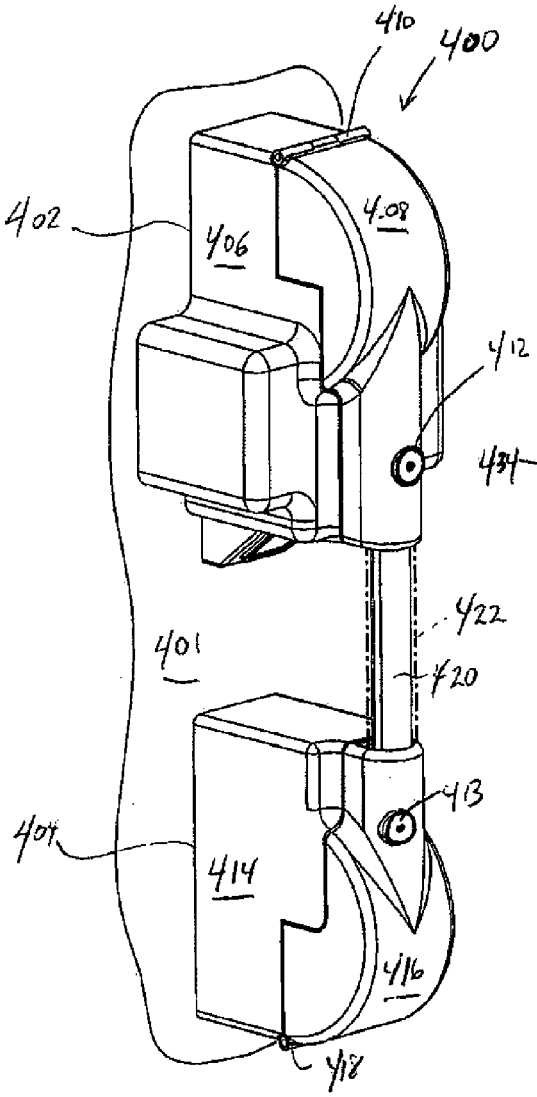
FIG. 35 is a perspective view of another embodiment of an automatic handle cover dispenser having a pair of main housing sections that house a pair of handle cover cartridges, and shown in accordance with one aspect of the present invention.

FIG. 35 is a perspective view of another embodiment of an automatic handle cover dispenser 400 having a pair of housing sections 402, 404 shown in accordance with one aspect of the present invention. The dispenser 400 is fastened or otherwise secured to a structure 401, such as a door. As shown, housing section 402 includes a main housing section 406 and a cover section 408 which can open about hinge 410 and which can be locked and unlocked via lock 412. Similarly, housing section 404 includes a main housing section 414 and a cover section 416 which can open about a hinge 418 and which is also lockable via lock 413. In general, the housing shape can vary to convenience, but preferably is designed to be aesthetically pleasing and to conform to and cover the internal mechanisms of the dispenser being housed. The housing can be made from a variety of materials, including metal and plastic. Moreover, while the dispenser is illustrated in a particular orientation, it should be understood that the orientation can vary to convenience. It is contemplated further that the structure to which the dispenser is secured can vary without departing from the spirit and scope of the present invention. In one embodiment, the structure may take the form of a flat or substantially flat door, but other applications again are contemplated (e.g., the device can be attached to a shopping cart). Dispenser 400 further comprises a handle 420, which as shown is of a tubular shape (to facilitate gripping by a user). And a handle cover material 422 (shown in phantom) is illustrated and positioned in overlay relationship with respect to the handle. In one embodiment, and as described above, the handle cover material comprises a continuous sleeve that surrounds or substantially surrounds the handle 420 as shown.

Figure 36:
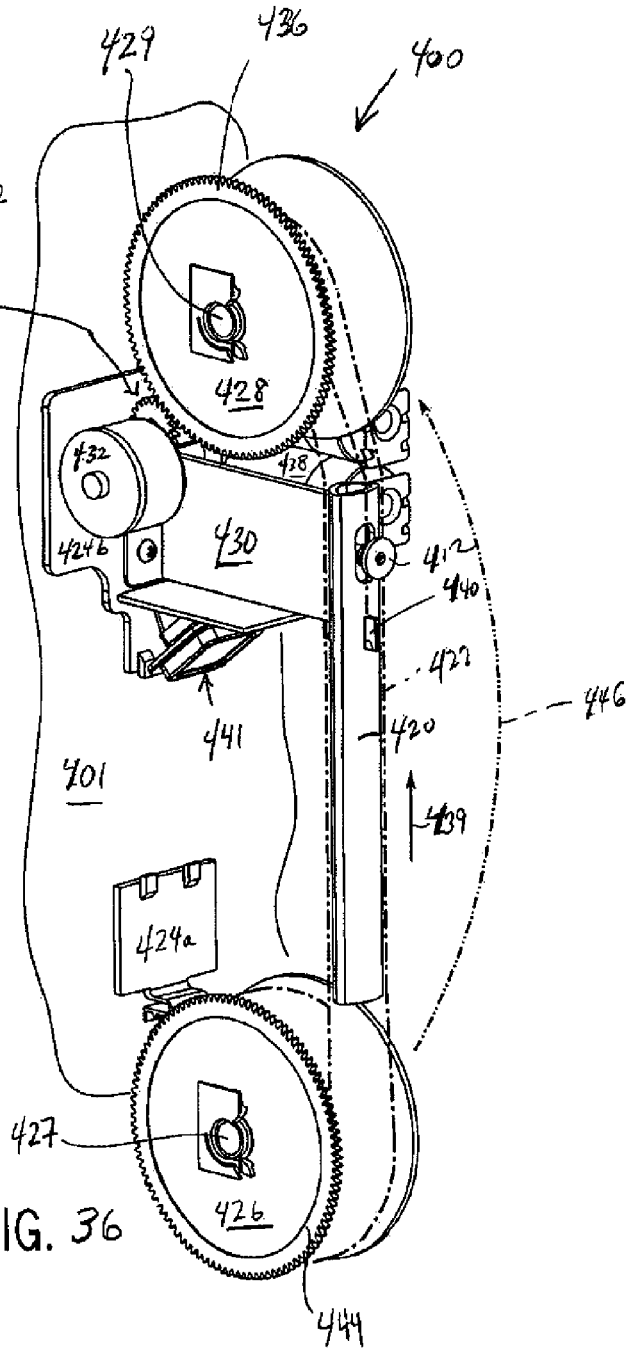
FIG. 36 is a perspective view of the dispenser of FIG. 35 with the main housing sections removed so as to view various of the internal components of the dispenser.

FIG. 36 is a perspective view of the dispenser 400 of FIG. 35 with the main housing sections removed so as to view internal components of the dispenser. The dispenser 400 again is shown secured to a structure 401 (e.g., bathroom door, cafeteria door, etc.) via plates 424*a-b*, which are secured via fasteners or other securing means (not shown). The dispenser is in the form of a tubular member. In the above-described embodiments, a dual-use handle cover refill cartridge was described. However, the present embodiment incorporates two discrete reels, namely, feed or supply reel 426 and take-up or collection reel 428. Supply reel 426 is connected to the support structure 401, as shown, via the securing mechanism 424*a*. Clips 427 facilitate such connection. Take-up reel 428 is connected to and supported by a supporting structure 430, which is connected to the supporting structure 401 via securing mechanism 424*b*. Clips 429 facilitate such connection. The supporting structure 430 also supports a motor mechanism 432. In the present embodiment, motor mechanism 432 drives rotational movement of take-up reel 428 via a gear train, generally referred to by the numeral 434. More specifically, the take-up reel 428 includes a drive gear 436 that is directly driven via the gear train 434. Supporting structure 430 further supports the PCB (not shown), as well as batteries 438 which power electro-mechanical features (e.g., the motor assembly).

Still referring to FIG. 36, to accomplish installation, sanitary handle cover material 422 is drawn upwardly as indicated by arrow 439 from the supply reel 426 to the take-up wheel 428, and in doing so is passed in overlay relation with respect to the handle 420. Cutting device 440 (as shown a two-sided blade) are used to divide or splice the handle cover material 422 so as to promote proper collection of the handle cover material at the take-up reel 428.

Still referring to FIG. 36, as shown, spool-like supply reel 426 also includes a gear 444. Once the supply reel 426 is depleted of handle cover material 422, it can be interchanged with the take-up reel 428. More specifically, the reels 426 and 428 can be disengaged and removed, and the take-up reel having soiled and/or used handle cover material can be discarded and/or recycled as desired. Significantly, since the supply reel 426 also includes a drive gear 444, it can be placed in the take-up reel location. Such replacement is indicated by arrow 446. In this fashion, the supply reel 426 can then used as the take-up reel. A new supply reel (not shown) can then be provided. Accordingly, and advantageously, because of the interchangeability of the reels, only one new reel (i.e., a new supply reel) need be provided when the handle cover material supply has been depleted.

Turning again briefly to FIG. 35, as the handle cover material 422 passes over the handle 420, they pass from the interior of housing section 404, over the handle portion (and thus exterior of any housing section), and then into an interior of housing section 402. Within housing section 402, the handle covers material passes over the cutter 440 that again serves to cut the sleeve material such that it can be wound upon take-up reel 428 (as well as to avoid interference with lock 412).

Referring again to FIG. 36, in use, drive mechanism 432 functions to advance the handle cover material 422 by rotating take up reel 428 via gearing mechanism 436. This draws the connected handle cover material over the handle 420 so that a sanitary surface is provided for a user using (i.e., grasping) the handle, for example, to move structure 401 (which as noted previously can be a door handle). An object-detection sensor (infrared, capacitance, etc.) 441 is also included to affect automatic advancement of the handle covers. The amount of handle cover material or handle cover material to advance during use can be monitored and/or metered in a manner based on various parameters as described above, although in the present embodiment, it is contemplated that magnetic sensing or switch technology could be preferably and therefore utilized. Additionally, and as noted previously, one of skill in the art will understand that various aspects (e.g., the housing, the type and placement of several of the electromechanical devices within the housing, etc.) of the present embodiment can vary to convenience, and thus, the invention should not be limited by such mechanism types and/or placements. Where the substrate to which the dispenser 400 is secured is a door, and similar to other embodiments of the present invention, the dispenser can serve to complement or replace a door handle.

In general, advantageously, at least some of the above-described embodiments can be used as a "retrofit" in virtually any type of door. Advantageously, it is still possible to utilize the door (via the door handle) even after all sanitary handle covers have been dispensed or if not functioning for any reason. Moreover, the embodiments are typically battery-powered. Object-detection sensors are typically employed to initiate advancement of the handle cover material, and can drive the handle cover material advancement over a predetermined distance (so as to replenish used cover material with unused material). Mechanical or electronic switch (e.g., micro switch), and/or smart chip technologies, among others, can be employed and used to determine the amount of sleeve or sleeve material to advance and also to determine when sleeve refill is required (i.e., upon depletion of the sleeves or sleeve material from the dispenser), LED's and/or sound (e.g., beeping) technology can be employed to signify when, for example, re-fill and/or new batteries are required. If the device malfunctions in some manner (e.g., the handle cover cutter does not operate), an automatic shut off mechanism is contemplated. According to various aspects of the present invention, one or more of the above described refill cartridges can be termed "re-fillable", "recyclable", and "disposable".

It should be understood that the above-mentioned sensor and switch technology comprise components and software (as well as associated algorithms). Such components and applications are available known to those of skill in the art. Software applications and associated programming can be customized according to the specific needs of the end use or end user and to leverage the various components used.

As noted above, the amount or quantity of handle cover material contained in the dispenser depends on a number of variables, including: a) the size of the cartridge and its components (e.g., reels within the cartridge); b) the thickness of the material; and c) the geometry of the device and its components (e.g., the length/diameter/size of the handle). In one embodiment of the present invention, it is contemplated that the dispenser can contain handle cover material such that it can be used many times (e.g., 1000 times or perhaps even much more) prior to installing any replacement cartridge. Still, the number of such "sanitary experiences" can vary to convenience. Various options for selecting the type and/or quantity of handle cover material are available. In one embodiment, for example, a customer might have the choice between a thick material and a relatively thin material. In another embodiment, a customer might be able to select from one of a short, medium and long handle. Options such as these can vary to convenience within or based on parameters that may be set, for example, by the manufacturer and customer. Each generally requires specific programming to ensure that all desired parameters are recognizable by the PCB and to permit appropriate amount of handle cover material to be used.

As noted above, the sensor technology utilized can vary to convenience. According to one aspect, the sensor technology used can comprise infrared, occupant sensing, capacitance sensing, all range and pulse variations of IR, and other sensor technology. Using known infrared technology (e.g., using a transmitter and a receiver), automatic advancement of handle cover material can be accomplished such that the material (e.g., the sleeve material) is advanced upon release of a user's hand from the handle. Use of such technology is appropriate in both low traffic and high traffic environments, such as when refills can be accomplished efficiently and frequently. In accordance with another aspect of the present invention, commonly termed 'wave sensing' (or short pulse and short range IR) technology can be used. Use of such technology is appropriate when it is desired to have handle cover material advancement tied to waving of a user's hand, and particularly, when it is desired to permit the user to decide when an unused material is desired (i.e., as opposed to automatic advancement of sleeves regardless of the user's desire). In accordance with yet another aspect of the present embodiment, capacitance and/or motion-sensing technology (or object-detection sensing) can be used. Standard capacitance and/or motion sensors can permit automatic advancement of sleeves, for example, when a door closes, hand is at a specified distance from the handle, or when the hand is removed from the handle. Here again, use of such technology is appropriate in both low traffic and high traffic environments, such as when refills can be accomplished efficiently and frequently. And in accordance with yet another aspect of the present invention, a combination of the aforementioned sensing technologies can be employed, permitting a customer and/or end user to decide which advancing technology and associated programming is optimal.

In general, one of skill in the art shall appreciate that variations can be made to the housing, gearing, handle, blade and cartridge configurations and components in these and other embodiments of the present invention. Such variations are contemplated and considered within the scope of the present invention and the present invention should not be considered limited by particular configurations shown which can be selected or varied based on design criteria, or which are a matter of design choice and thus can vary to convenience.

From the foregoing and as mentioned above, it will be observed that numerous variations and modifications may be effected without departing from the spirit and scope of the novel concepts of the invention. It is to be understood that no limitation with respect to the specific methods and apparatus illustrated herein is intended or should be inferred. It is, of course, intended to cover by the appended claims all such modifications as fall within the scope of the claims.

We claim:

1. A handle cover dispenser comprising:

a housing;

a motor disposed within an interior of the housing;

a handle extending from the housing; and a dual-use handle cover refill cartridge disposed within the housing interior, the dual-use handle cover refill cartridge in operational association with the motor and comprising a supply section for supplying a handle cover material to cover the handle and a collection section for collecting the handle cover material from the handle, such that the handle cover material, when supplied, at least partially covers the handle, wherein the supply section is configured to remain fixedly secured to the collection section after removal of the dual-use handle cover refill cartridge from the housing.

2. The dispenser of 1 wherein the dual-use handle cover refill cartridge further comprises a second collection section separated from the first collection section, and wherein each of the first and second collection sections are configured to collect a portion of the handle cover material from the handle.

3. The dispenser of claim 1 wherein the housing is securable to a flat or substantially flat substrate or structure and, when so secured, the dual-use handle cover refill cartridge includes a spool that is oriented to rotate about an axis that is parallel or substantially parallel with respect to the substrate or structure.

4. The dispenser of claim 1 wherein the housing is securable to a flat or substantially flat substrate or structure, and when so secured, the dual-use handle cover refill cartridge includes a spool that is oriented to rotate about an axis that is angled with respect to the substrate or structure.

5. The dispenser of claim 1 wherein the housing is securable to a flat or substantially flat door.

6. The dispenser of claim 1 further comprising a continuous handle cover material.

7. The dispenser of claim 6 wherein the continuous handle cover material is a continuous sleeve.

8. The dispenser of claim 1 further comprising at least one object detection sensor for use in at least one of automatically supplying and automatically collecting the handle cover material.

9. The dispenser of claim 1 further comprising at least one cutter for cutting the handle cover material to facilitate collection of handle cover material.

10. The dispenser of claim 1 wherein the handle comprises a handle core and a handle overlay that can be received by the handle core to facilitate installation or use of the handle cover material.

11. The dispenser of claim 1 further comprising a drive mechanism that is in operative association with the motor, the drive mechanism for driving supply from and collection to the dual-use handle cover refill cartridge.

12. The dispenser of claim 1 further comprising a device that both measures and meters the handle cover material and/or guides the handle cover material as the material is drawn from the supply section of the dual-use handle cover refill cartridge and serves to ensure that a proper amount of the handle cover material is provided to the handle after each use and is capable of signaling depletion or emptying of the dual-use handle cover refill cartridge.

13. The dispenser of claim 1 further comprising a handle cover material having an interior surface, wherein the handle has a hollow interior and the dual-use handle cover refill cartridge is configured to pass the handle cover material through the hollow interior and the collection section is configured to collect the handle cover material from the exterior of the handle such that the handle cover material is turned inside out, thereby exposing the interior surface of the handle cover material when it is passed over the handle so as to provide an additional amount of sanitization.

14. The dispenser of claim 1 wherein the dispenser can be used with a retrofit or security mechanism that is capable of at least substantially eliminating the introduction of an objectionable material into an interior of the handle.

15. The dispenser of claim 1 further comprising a cartridge housing, wherein the supply section and the collection section are housed within the cartridge housing.

16. The dispenser of claim 1, wherein the supply section comprises a first spool and the collection section comprises a second spool fixedly secured to the first spool.

17. A door handle cover dispenser assembly for use with a lockable door handle assembly, the dispenser assembly comprising:

a housing;

a motor disposed within an interior of the housing;

a door handle extending from the housing;

a dual-use door handle cover refill cartridge disposed within the housing interior, the dual-use handle cover refill cartridge in operational association with the motor and comprising a supply section for supplying a handle cover material to cover the handle and a collection section for collecting the handle cover material from the handle, such that the handle cover material, when supplied, at least partially covers the handle, wherein the supply section is configured to remain fixedly secured to the collection section after removal of the dual-use handle cover refill cartridge from the housing;

a first plate that is connected to the housing; and a second plate connected to the first plate, the second plate is connected to a door;

wherein the first plate can slide with respect to the second plate such that when the handle of the dispenser is pushed or pulled, the dispenser can move with respect to the second plate in a corresponding manner to unlock the lockable door handle assembly.

18. The dispenser assembly of claim 17 wherein the first plate is slidably connected to the second plate via a series of interlocking tabs and a stop stud connected to the first plate that interfaces with a groove in the second plate.

19. In a handle cover dispenser having a housing, a motor disposed within an interior of the housing, and a handle that extends outwardly from the housing, a dual-use handle cover refill cartridge disposed within the housing interior and in operational association with the motor, the dual-use handle cover refill cartridge comprising;

a supply section for supplying a handle cover material to cover the handle; and a first take-up section in operative association with the supply section, the first take-up section for collecting at least a portion of the handle cover material from the handle;

the dual-use handle cover refill cartridge configured such that the handle cover material, when supplied from the supply section and prior to being collected by the first take-up section, at least partially covers the handle during use by a consumer, thereby promoting and maintaining the sanitary integrity of the handle, and further wherein the supply section is configured to remain fixedly secured to the first take-up section after removal of the dual-use handle cover refill cartridge from the housing.

20. The dual-use handle cover refill cartridge of claim 19 further comprising a second take-up section separated from the first take-up section, and wherein the first and second take-up sections are each configured to collect a portion of the handle cover material when it has been supplied to the handle by the supply section.

21. The dual-use handle cover refill cartridge of claim 20 further comprising a drive mechanism that is in operative association with a motor assembly, the drive mechanism for driving supply from the supply section and collection to the first and second take-up sections.

22. The dual-use handle cover refill cartridge of claim 20 further comprising a metering mechanism for dosing an amount or quantity of handle cover material to dispense from the supply section, or take-up from the first and second take-up sections.

23. The dual-use handle cover refill cartridge of claim 20, wherein the second take-up section rotates along with the supply and the first take-up sections about a common axis that is substantially perpendicular to the longitudinal axis of the handle.

24. The dual-use handle cover refill cartridge of claim 19, further comprising a handle cover material having an interior surface, wherein the handle has a hollow interior and the dual-use handle cover refill cartridge is configured to pass the handle cover material through the hollow interior and the take-up section is configured to collect the handle cover material from the exterior of the handle such that the handle cover material is turned inside out, thereby exposing the interior surface of the handle cover material when it is passed over the handle, so as to provide an additional amount of sanitization.

25. The dual-use handle cover refill cartridge of claim 19, wherein the supply and the first take-up sections rotate about a common axis.

26. The dual-use handle cover refill cartridge of claim 25, wherein the common axis is substantially perpendicular to a longitudinal axis of the handle.

27. The dual-use handle cover refill cartridge of claim 19 further comprising an axle, wherein the supply section and the collection section are mounted on and configured to rotate about the axle.

28. A handle cover dispenser comprising:

a housing;

a handle extending from the housing;

a supply section for supplying a handle cover material to the handle, the supply section disposed within the housing;

a first collection section for collecting the handle cover material from the handle, the first collection section disposed within the housing; and a handle cover material comprising a sleeve having an interior surface;

wherein the handle has a hollow interior and the supply section is configured to feed the handle cover material through the hollow interior of the handle and the first collection section is configured to collect the handle cover material from the exterior of the handle after it has been fed through the hollow interior of the handle and then back over the exterior of the handle such that the handle material, when supplied, is turned inside out, thereby exposing the interior surface when it is passed over the handle.

29. The dispenser of claim 28 further comprising at least one cutter configured to cut the handle cover material to facilitate collection of handle cover material.

30. The dispenser of claim 29 further comprising a second collection section separated from the first collection section, wherein each of the first and second collection sections collect a portion of the handle cover material from the handle.

* * * * *

UNITED STATES PATENT AND TRADEMARK OFFICE

CERTIFICATE OF CORRECTION

PATENT NO. : 7,762,492 B2
APPLICATION NO. : 11/279678
DATED : July 27, 2010
INVENTOR(S) : Todd J. Muderlak and Kenneth J. Muderlak It is certified that error appears in the above-identified patent and that said Letters Patent is hereby corrected as shown below:

On the Title page item (73) replace:

"Assignee: Muderlak Design, Inc., Milwaukee, WI (US)" with
--Assignee: Xela Innovations, LLC, Glendale, WI (US)--.

Signed and Sealed this

Sixteenth Day of November, 2010

David J. Kappos

David J. Kappos
*Director of the United States Patent and Trademark Office*